US009844794B2

(12) United States Patent
Minami et al.

(10) Patent No.: US 9,844,794 B2
(45) Date of Patent: Dec. 19, 2017

(54) SUBSTRATE PLATING APPARATUS AND SUBSTRATE PLATING METHOD

(71) Applicant: EBARA CORPORATION, Tokyo (JP)

(72) Inventors: Yoshio Minami, Tokyo (JP); Masaaki Kimura, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 290 days.

(21) Appl. No.: 14/257,929

(22) Filed: Apr. 21, 2014

(65) Prior Publication Data

US 2014/0314957 A1 Oct. 23, 2014

(30) Foreign Application Priority Data

Apr. 23, 2013 (JP) ..... 2013-090773

(51) Int. Cl.

| | |
|---|---|
| ***B08B 3/04*** | (2006.01) |
| ***B05C 3/02*** | (2006.01) |
| ***B05C 21/00*** | (2006.01) |
| ***B05C 3/04*** | (2006.01) |
| ***C25D 17/00*** | (2006.01) |
| ***C25D 17/06*** | (2006.01) |
| ***C25D 21/08*** | (2006.01) |

(52) U.S. Cl.

CPC ..... *B05C 3/02* (2013.01); *B05C 3/04* (2013.01); *B05C 21/00* (2013.01); *B08B 3/047* (2013.01); *C25D 17/001* (2013.01); *C25D 17/004* (2013.01); *C25D 17/06* (2013.01); *C25D 21/08* (2013.01)

(58) Field of Classification Search

CPC .... C25D 17/001; C25D 17/004; C25D 17/06; B05C 3/02; B05C 3/04; B05C 21/00; B08B 3/045–3/047; B08B 3/10; B08B 3/102; B08B 3/108

See application file for complete search history.

(56) References Cited

U.S. PATENT DOCUMENTS 6,685,814 B2 * 2/2004 Uzoh ..... C25D 5/08 205/123
2005/0283993 A1 * 12/2005 Wu ..... B08B 3/102 34/443

FOREIGN PATENT DOCUMENTS

| | | |
|---|---|---|
| JP | 08-064571 A | 3/1996 |
| JP | 09-321016 A | 12/1997 |
| JP | 11-097404 A | 4/1999 |
| JP | 2000-58486 | 2/2000 |
| JP | 2002-535831 | 10/2002 |
| JP | 2008-223094 | 1/2004 |

(Continued)

*Primary Examiner* — Dah-Wei D. Yuan
*Assistant Examiner* — Stephen A Kitt
(74) *Attorney, Agent, or Firm* — Baker & Hostetler LLP

(57) ABSTRACT

A substrate plating apparatus is disclosed. The apparatus includes a substrate holder; a plating bath configured to plate a surface of the substrate in a plating solution; a cleaning bath configured to clean the substrate holder and the substrate with a cleaning liquid; an inner shell disposed in the cleaning bath and configured to house the substrate holder holding the substrate therein; and a cleaning liquid supply conduit configured to supply a cleaning liquid into the inner shell to clean the substrate, together with the substrate holder, with the cleaning liquid. The inner shell has an inner surface having an uneven configuration that follows an uneven exterior configuration of the substrate holder holding the substrate.

13 Claims, 29 Drawing Sheets

(56) References Cited

FOREIGN PATENT DOCUMENTS

| | | | |
|---|---|---|---|
| JP | 2004-076072 | A | 3/2004 |
| JP | 2004-14642 | | 9/2008 |
| JP | 2009-202111 | A | 9/2009 |
| TW | 200815115 | A | 4/2008 |
| TW | 201218296 | A | 5/2012 |

* cited by examiner

SUBSTRATE PLATING APPARATUS AND SUBSTRATE PLATING METHOD

CROSS REFERENCE TO RELATED APPLICATION

This application claims priority to Japanese Patent Application No. 2013-090773 filed Apr. 23, 2013, the entire contents of which are hereby incorporated by reference.

BACKGROUND

There has been known a plating apparatus that performs plating of a substrate surface by immersing a substrate such as a semiconductor wafer, held by a substrate holder, in a plating solution. In this type of plating apparatus, after the plating, the substrate holder, holding the substrate, is immersed in a cleaning liquid, such as pure water, stored in a cleaning bath to clean the substrate and the substrate holder. By immersing the substrate holder, holding the substrate, in the cleaning liquid in this manner, a liquid chemical such as the plating solution, adhering to the substrate and the substrate holder, is removed from them by basically diffusion due to a difference in the concentration between the liquids. The cleaning liquid in which the liquid chemical, such as the plating solution, has been diffused is discharged from the cleaning bath, so that one cleaning cycle using the cleaning liquid is completed. This cleaning cycle is repeated multiple times.

The cleaning bath for use in such post-plating cleaning of a substrate and a substrate holder generally has a shape of an open-top box with a constant opening area. Dimensions (i.e., a thickness, a width, and a depth) of the interior space of the cleaning bath are set to be large enough to prevent contact of the substrate holder with the cleaning bath when the substrate holder is introduced into the cleaning bath and the substrate holder is raised from the cleaning bath, taking into consideration the maximum thickness, the maximum width, and the immersion depth of the substrate holder.

An amount of the cleaning liquid, such as pure water, to be used in one cleaning cycle is determined by the volume of the cleaning bath that is determined from the product of the opening area and the depth of the cleaning bath. The total amount of the cleaning liquid to be used in a cleaning process consisting of multiple cleaning cycles, excepting an extra amount of the cleaning liquid to be supplied for the purpose of overflowing and an additional amount of the cleaning liquid to be supplied e.g., from a shower head, is equal to the product of the number of cleaning cycles and a value obtained by subtracting the volume of the substrate holder from the interior volume of the cleaning bath.

The applicant has proposed a substrate plating apparatus in which a narrow flow passage (processing chamber) is formed between an openable/closable lid provided in a cleaning bath and a substrate held in a bath body (see Japanese Laid-Open Patent Publication No. 2000-58496). A plating solution is passed through the flow passage while allowing the plating solution to flow along a surface of the substrate.

An apparatus has been proposed which, in order to reduce the use of a processing fluid, introduces the processing fluid into a narrow space between two plates which are movable in directions closer to and away from each other (see Japanese Laid-Open Patent Publication No. 2002-535831 (Translation of PCT Application)). A cleaning apparatus has been proposed which introduces a cleaning liquid into a cleaning chamber in which a cleaning object is set, and performs cleaning of the cleaning object while repeating pressurization and depressurization of the cleaning liquid (see Japanese Laid-Open Patent Publication No. 2004-14642).

Further, an apparatus has been proposed in which a processing object, which is suspended in a vertical position by a transport device, is surrounded by a surrounding means, and the processing object is cleaned by supplying a processing liquid into the surrounding means (see Japanese Laid-Open Patent Publication No. 2008-223094).

A substrate holder is configured to hold a substrate while sealing a gap between a peripheral portion of the substrate and the substrate holder with a sealing member. The substrate holder is immersed in a plating solution while holding the substrate. In general, the front surface of the substrate holder, holding the substrate, is not flat. Irregularities, including a fairly large recess having a diameter which is approximately equal to the diameter of the substrate, are formed in the front surface of the substrate holder holding the substrate. The front surface of the substrate holder thus has an uneven configuration. When such substrate holder holding the substrate is placed in a box-like cleaning bath so that the substrate and the substrate holder are cleaned with a cleaning liquid such as pure water, a large amount of the cleaning liquid flows into the recess formed by the substrate and the substrate holder, resulting in an increase in the amount of the cleaning liquid used. Further, according to this cleaning method, the use of cleaning liquid increases as the size of substrates increases.

A substrate holder, including a structure for sealing a gap between a peripheral portion of a substrate and the substrate holder, has a certain degree of thickness. When cleaning such a substrate holder with the use of the above-described box-like cleaning bath which is designed taking into consideration the maximum thickness, the maximum width, and the immersion depth of the substrate holder, it is necessary to use a cleaning liquid in a large amount. This problem will be more significant for substrates of a larger size. In the case of immersion cleaning using such a cleaning bath, it takes some time to store a cleaning liquid into the cleaning bath and to discharge the cleaning liquid from the cleaning bath in one cleaning cycle. Accordingly, when a cleaning process is performed by repeating the cleaning cycle multiple times, it takes a long time to complete the cleaning process.

None of the above-referenced patent documents are directed to a cleaning technique for cleaning a substrate holder, holding a substrate, with a cleaning liquid in a cleaning bath, the substrate holder being configured to hold the substrate while sealing a peripheral portion of the substrate with a sealing member, and having been subjected to plating of the substrate by immersing the substrate holder, holding the substrate, in a plating solution.

In the apparatus disclosed in the above-referenced Japanese Laid-Open Patent Publication No. 2008-223094, a processing liquid is supplied into the interior space of the surrounding member, having larger dimensions than the maximum width and the maximum thickness of a processing object and the transport device, without taking the uneven exterior configuration of the transport device into consideration. Therefore, the processing apparatus requires the use of a large amount of the processing liquid. In addition, a processing object is cleaned with the processing liquid while circulating the processing liquid. Therefore, the processing liquid can become contaminated gradually, resulting in insufficient cleaning of the processing object.

SUMMARY OF THE INVENTION

It is therefore an object to provide a substrate plating apparatus and a substrate plating method which can clean a substrate, held by a substrate holder, with use of a smaller amount of cleaning liquid without lowering a throughput.

Embodiments, which will be described hereinafter, relate to a substrate plating apparatus and a substrate plating method of dip type which use a substrate holder for holding a substrate, such as a wafer, and immersing the substrate into a plating solution so as to form connection bumps, interconnects, and the like on the substrate surface.

In an embodiment, a substrate plating apparatus includes: a substrate holder configured to hold a substrate with a sealing member pressing on a peripheral portion of the substrate; a plating bath configured to plate a surface of the substrate when the substrate, held by the substrate holder, is immersed in a plating solution; a cleaning bath configured to clean the substrate holder and the substrate with a cleaning liquid; an inner shell disposed in the cleaning bath and configured to house therein the substrate holder holding the substrate, the inner shell being configured to be able to be opened and closed and having an inner surface which has an uneven configuration that follows an uneven exterior configuration of the substrate holder holding the substrate; and a cleaning liquid supply conduit configured to supply a cleaning liquid into the inner shell when the inner shell in a closed state to clean the substrate, together with the substrate holder, with the cleaning liquid.

In an embodiment, a gap of 1 mm to 5 mm is formed between the inner surface of the inner shell in the closed state and the substrate holder.

In an embodiment, the substrate plating apparatus further includes a gas feed line configured to feed a gas into the cleaning liquid to be supplied into the inner shell in the closed state.

In an embodiment, the substrate plating apparatus further includes a mechanism configured to cause a surface level of the cleaning liquid in the inner shell to fluctuate vertically when the inner shell is in the closed state.

In an embodiment, the mechanism is one of an oscillation mechanism configured to cause walls of the inner shell to oscillate, a diaphragm drive mechanism configured to vibrate a diaphragm in contact with the cleaning liquid in the inner shell, and a syringe mechanism or pump device configured to repeatedly supply and discharge the cleaning liquid into and from the inner shell.

In an embodiment, the inner shell has a plurality of peripheral holes and a central hole, the peripheral holes being arranged so as to face a peripheral portion of the substrate, the central hole being arranged so as to face a central portion of the substrate, and the cleaning liquid being supplied into the inner shell through at least one of the central hole and the peripheral holes.

In an embodiment, the inner shell has a plurality of peripheral holes and a central hole through which the cleaning liquid is supplied into the inner shell, the peripheral holes being arranged so as to face a peripheral portion of the substrate, and the central hole being arranged so as to face a central portion of the substrate.

In an embodiment, the substrate plating apparatus further includes a substrate holder moving mechanism configured to cause the substrate holder to oscillate horizontally.

In an embodiment, a substrate plating method includes: holding a substrate by a substrate holder with a sealing member pressing on a peripheral portion of the substrate; plating a surface of the substrate while immersing the substrate, held by the substrate holder, in a plating solution; placing the plated substrate, held by the substrate holder, in an inner shell which is in an opened state; closing the inner shell to bring an inner surface of the inner shell, having an uneven configuration that follows an uneven exterior configuration of the substrate holder holding the substrate, into proximity to the substrate holder and the substrate; and supplying a cleaning liquid into the inner shell in the closed state to clean the substrate, together with the substrate holder, in the inner shell.

In an embodiment, a gap of 1 mm to 5 mm is formed between the inner surface of the inner shell in the closed state and the substrate holder.

In an embodiment, the substrate plating method further includes feeding a gas into the cleaning liquid to be supplied into the inner shell in the closed state.

In an embodiment, the substrate plating method further includes causing a surface level of the cleaning liquid in the inner shell to fluctuate vertically.

In an embodiment, supplying the cleaning liquid comprises supplying a cleaning liquid through a plurality of through-holes into the inner shell in the closed state to clean the substrate, together with the substrate holder, in the inner shell, the through-holes being arranged so as to face the surface of the substrate.

In an embodiment, supplying the cleaning liquid comprises supplying a cleaning liquid through at least one of a central hole and a plurality of peripheral holes into the inner shell in the closed state to clean the substrate, together with the substrate holder, in the inner shell, the peripheral holes being arranged so as to face a peripheral portion of the substrate, and the central hole being arranged so as to face a central portion of the substrate.

In an embodiment, the substrate plating method further includes after supplying the cleaning liquid into the inner shell in the closed state, causing the substrate holder to oscillate horizontally.

The inner shell has an interior configuration that is complementary to the exterior configuration of the substrate holder holding a substrate. This configuration can reduce the amount of the cleaning liquid used in one cleaning cycle. This can also reduce the time to supply and discharge the cleaning liquid into and from the inner shell. It therefore becomes possible to increase a time for a plating solution, adhering to the substrate holder and a substrate, to disperse into the cleaning liquid, or to increase the number of cleaning cycles. Thus, it becomes possible to enhance the cleaning effect without lowering the throughput.

Figure 11:
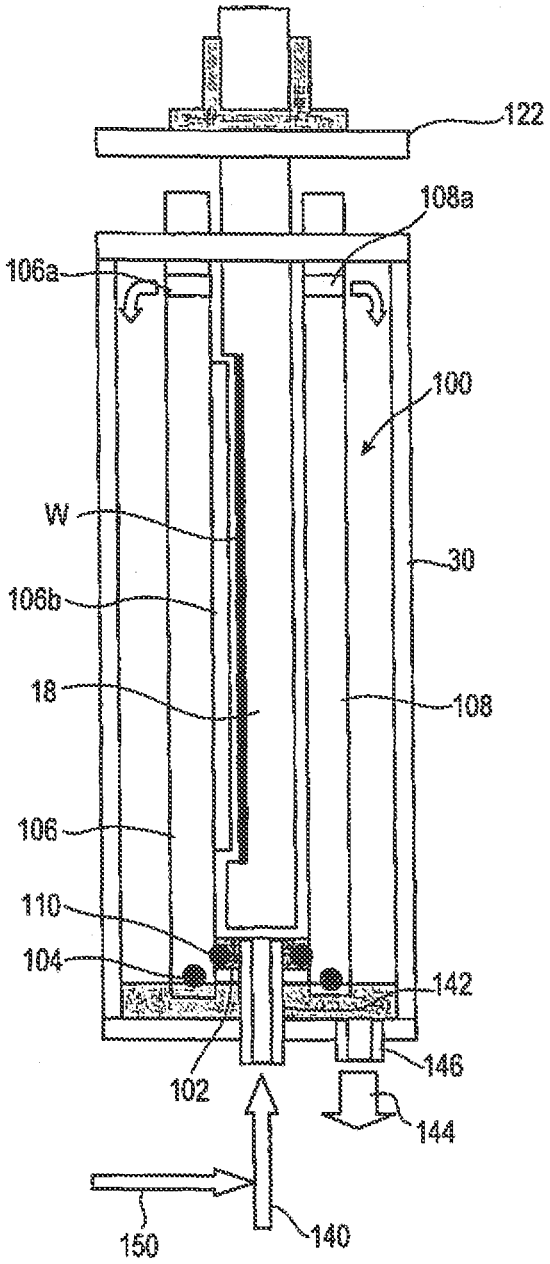
Figure 12:
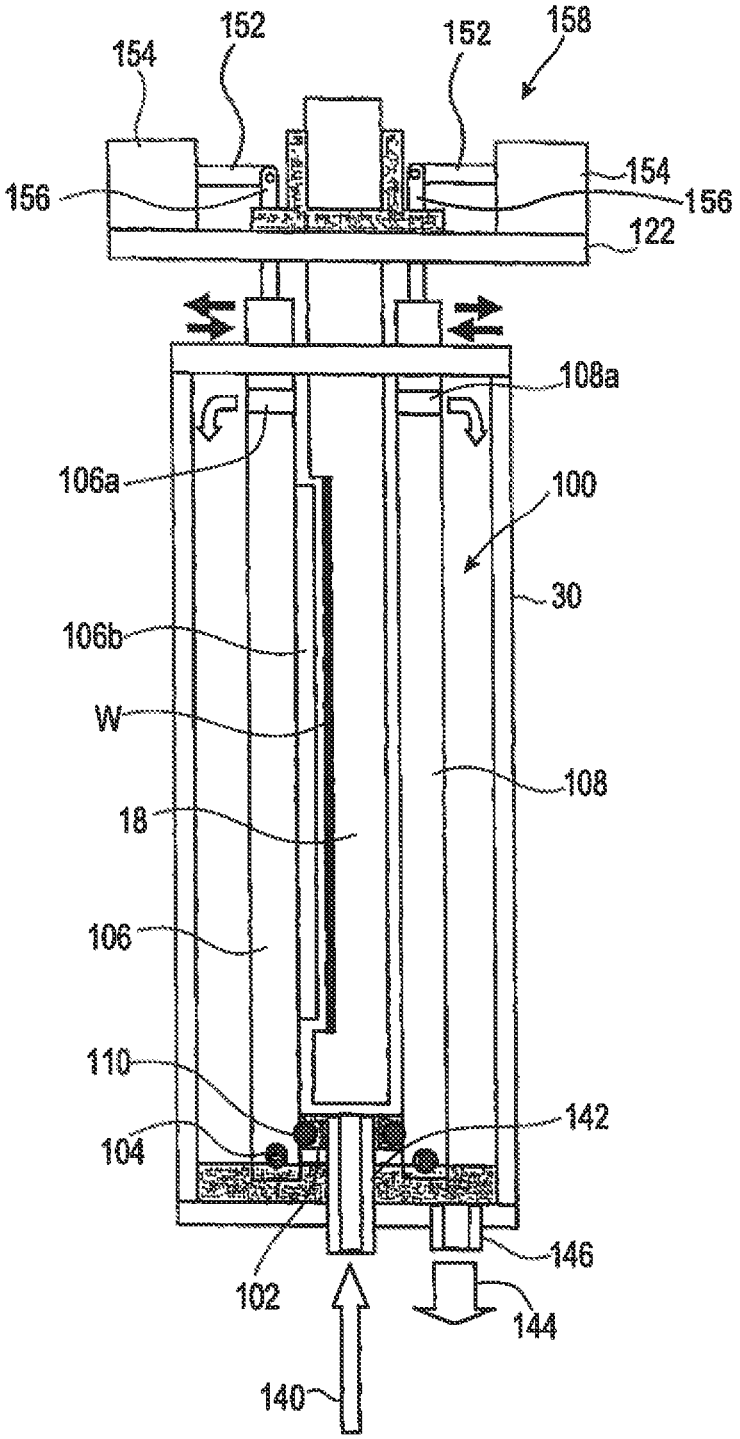
Figure 13:
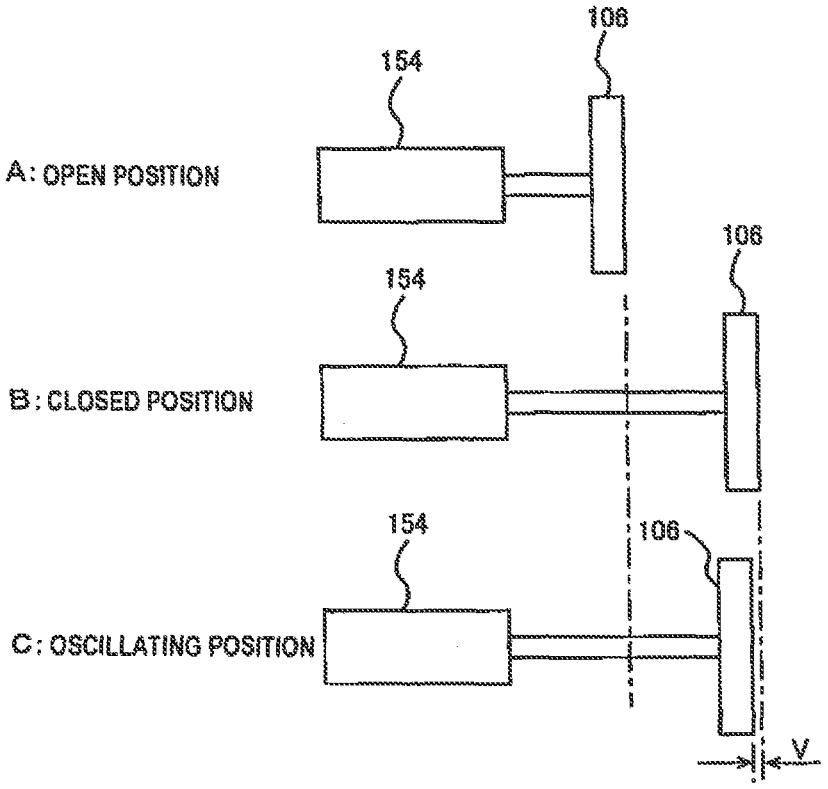
Figure 14:
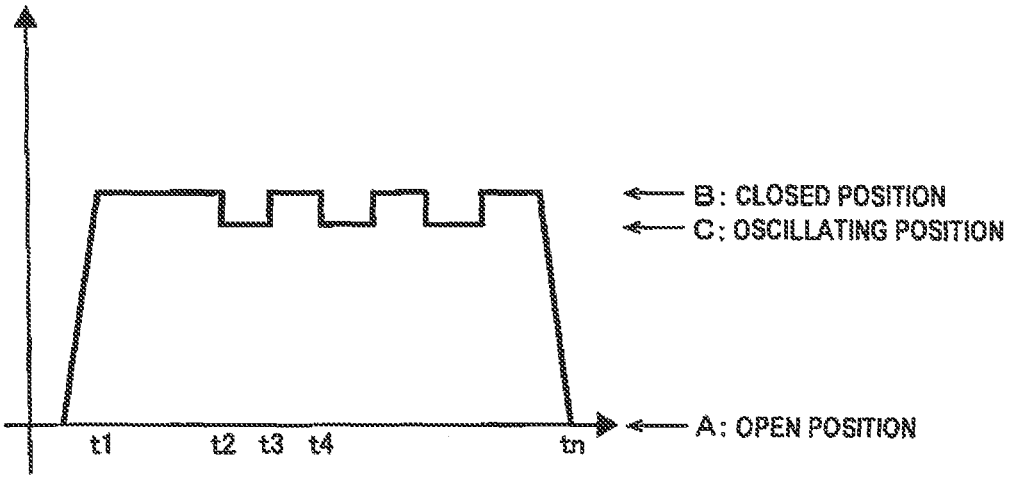
Figure 15:
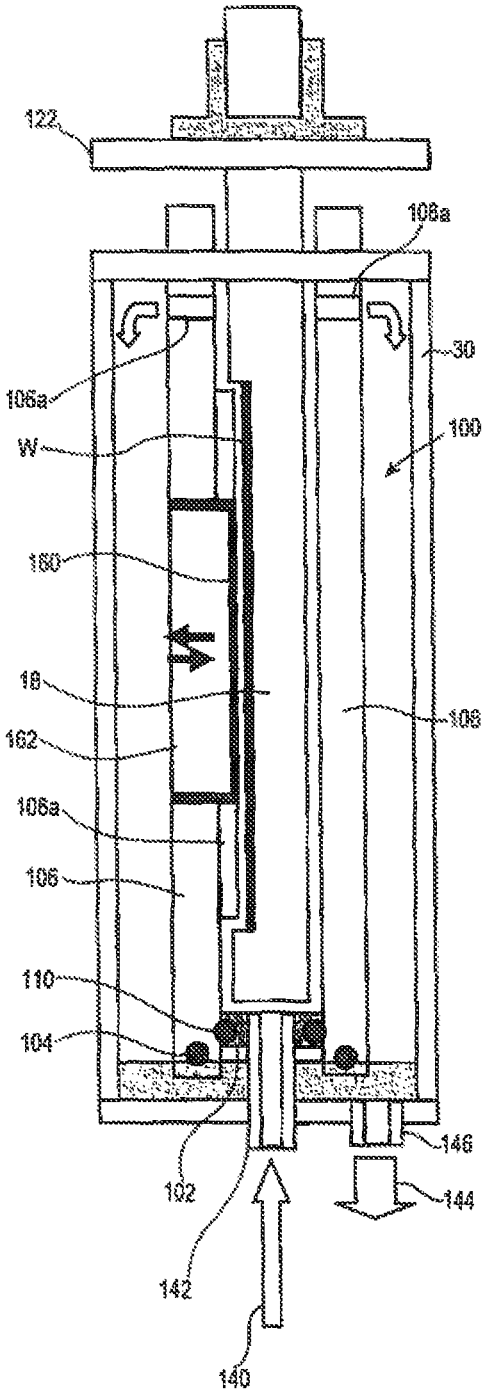
Figure 16:
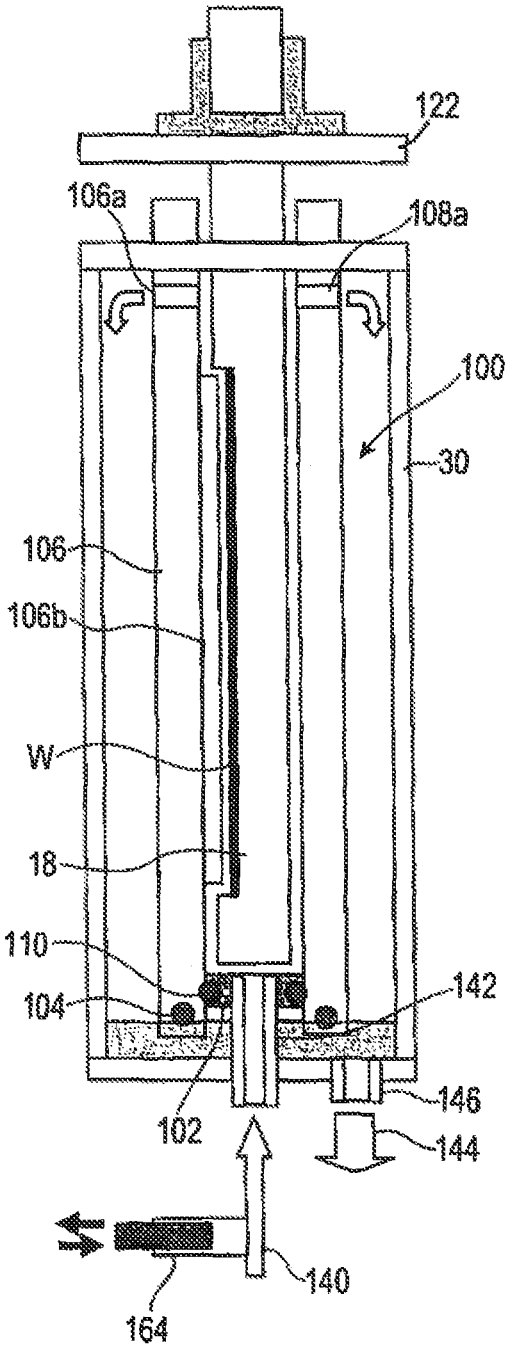
Figure 17:
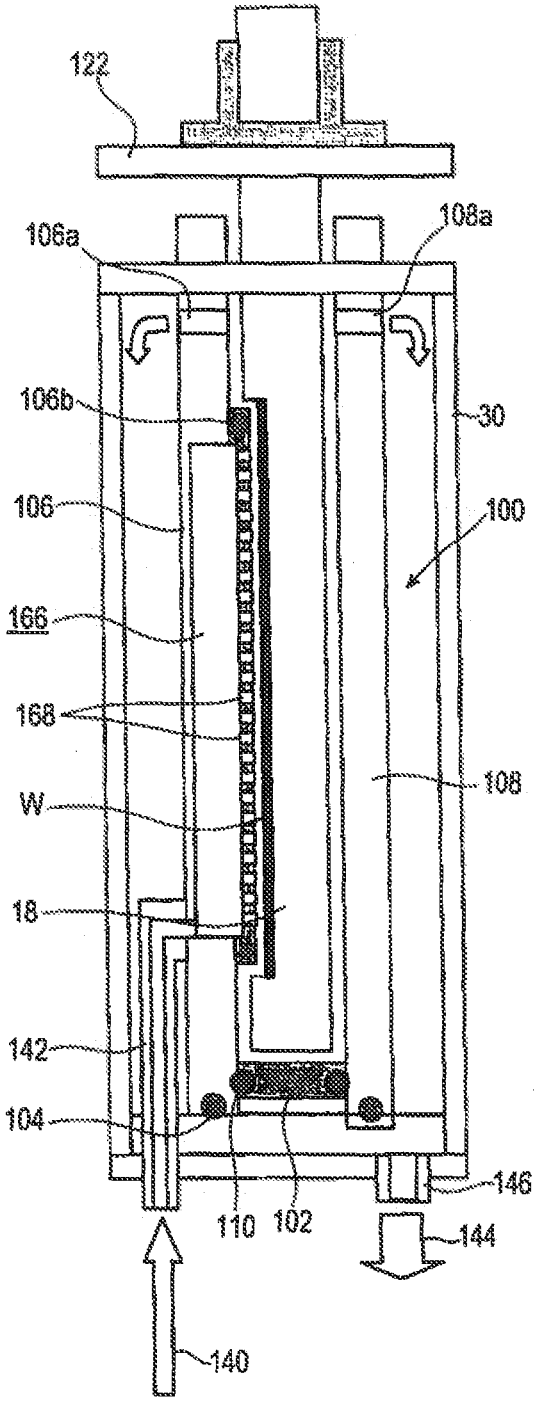
Figure 18:
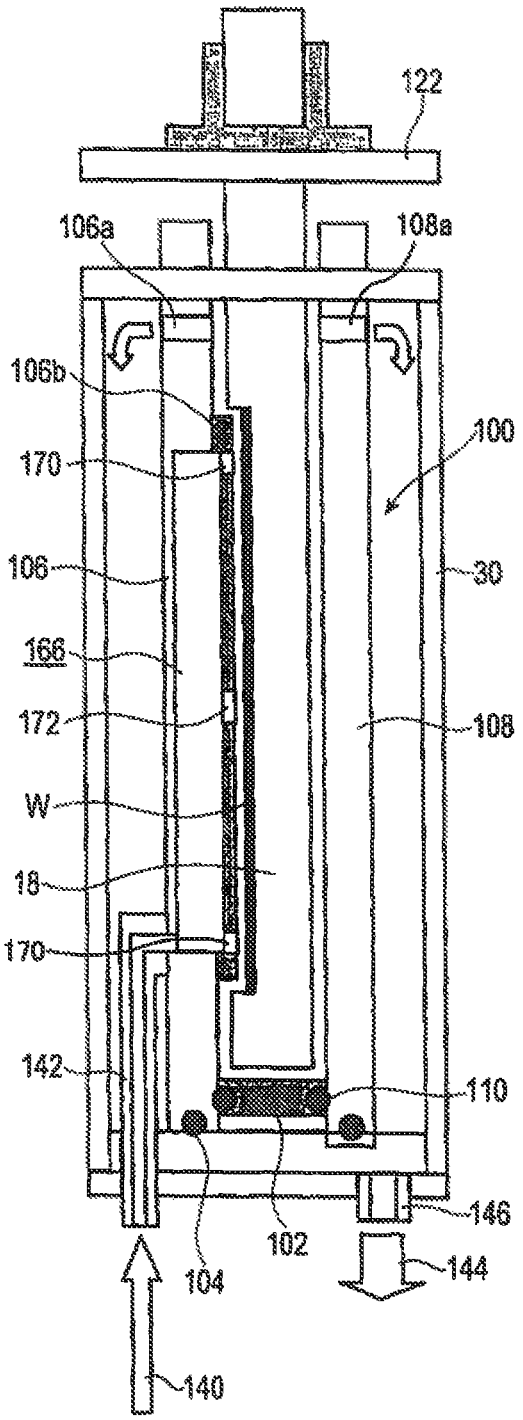
Figure 19:
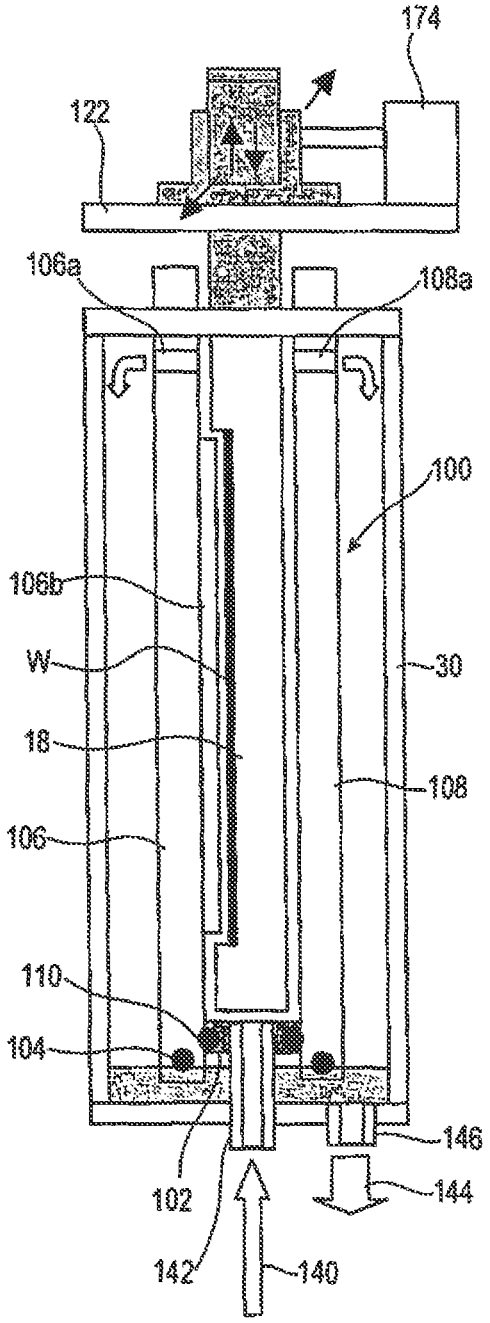
Figure 20:
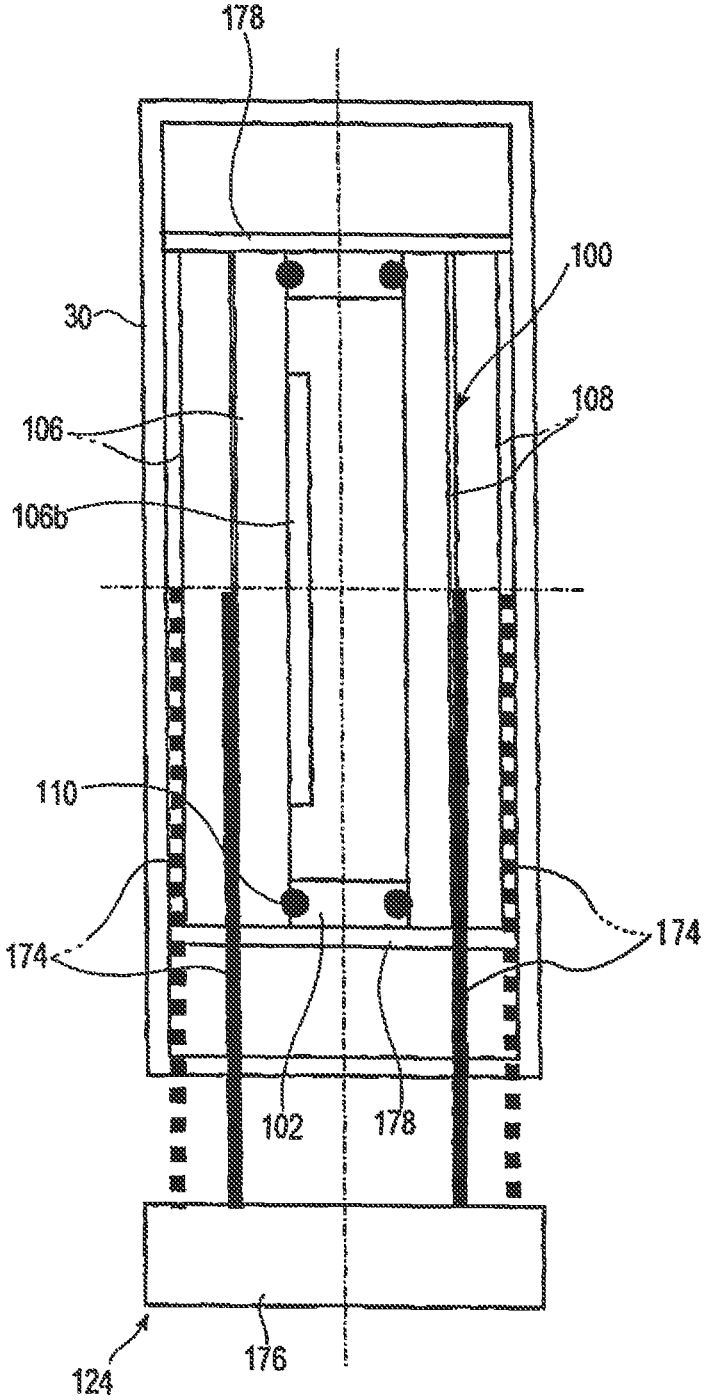
Figure 21:
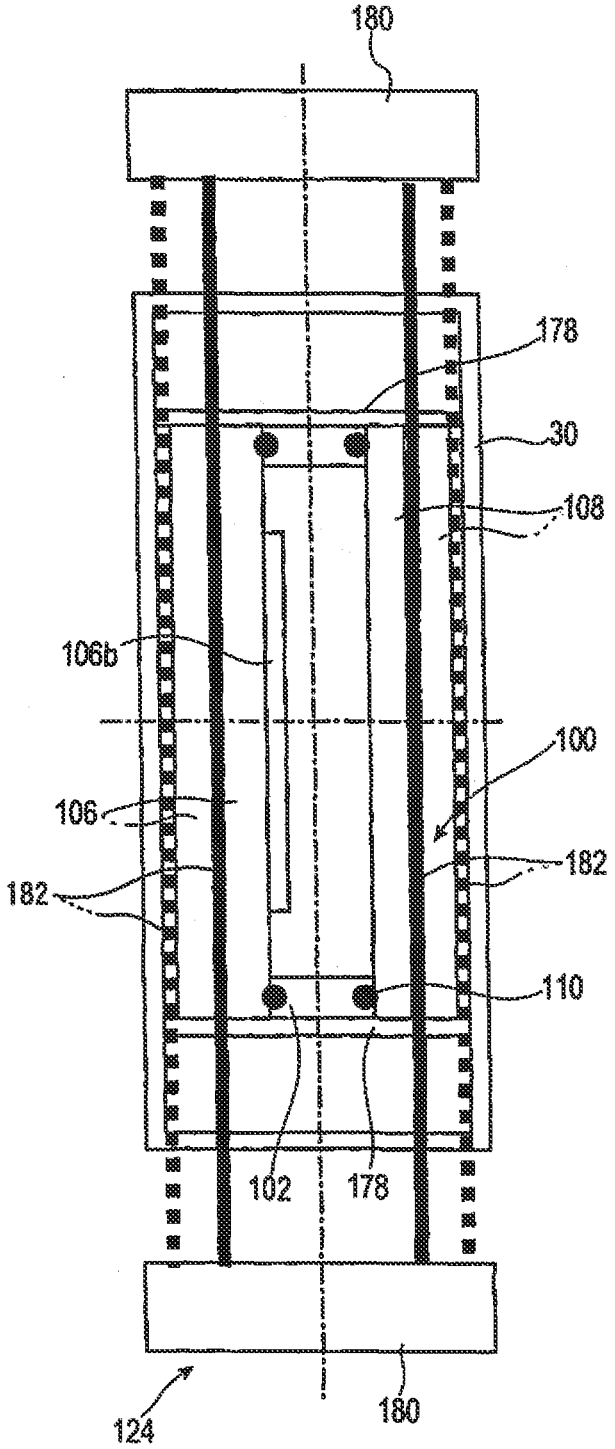
Figure 22:
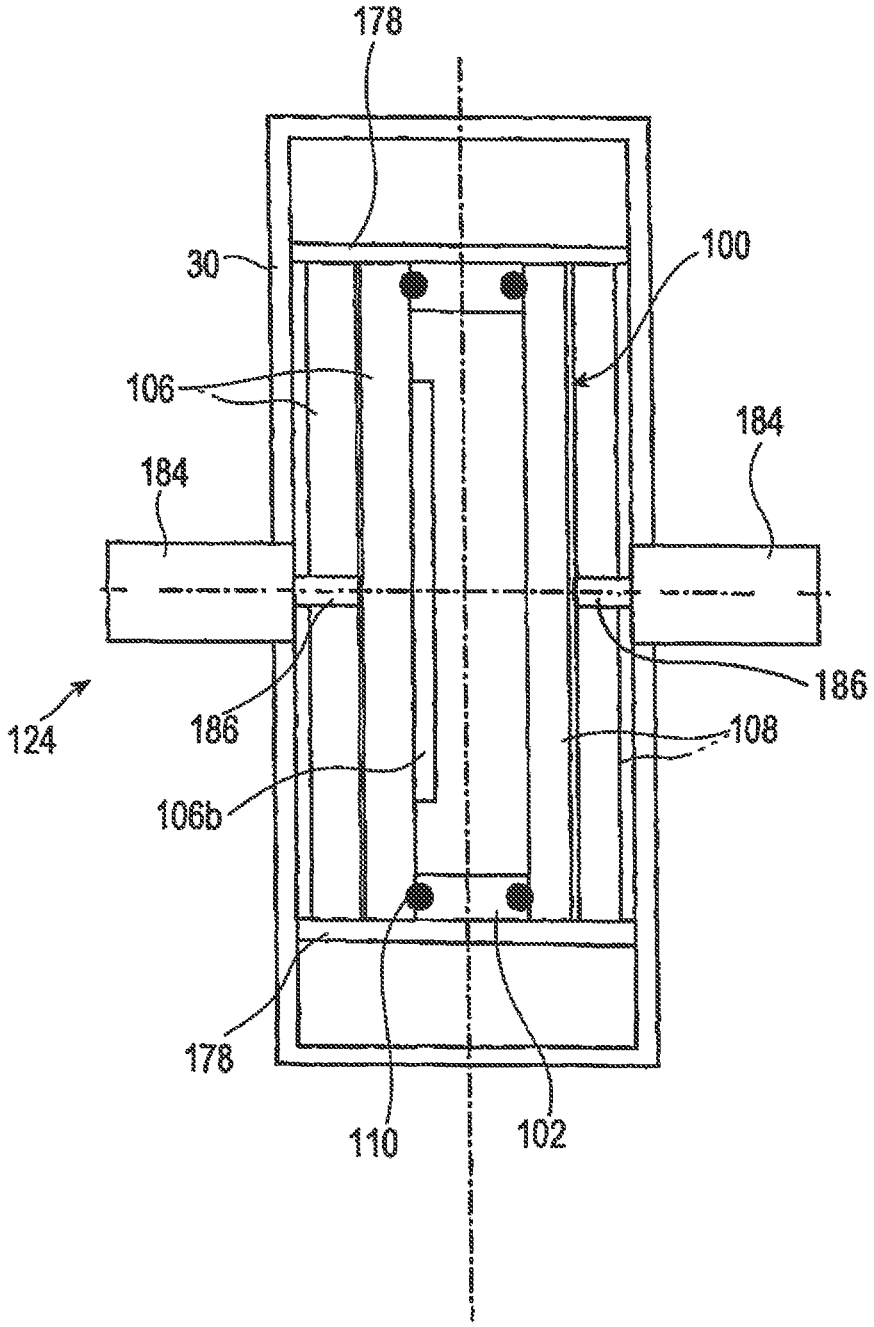
Figure 23:
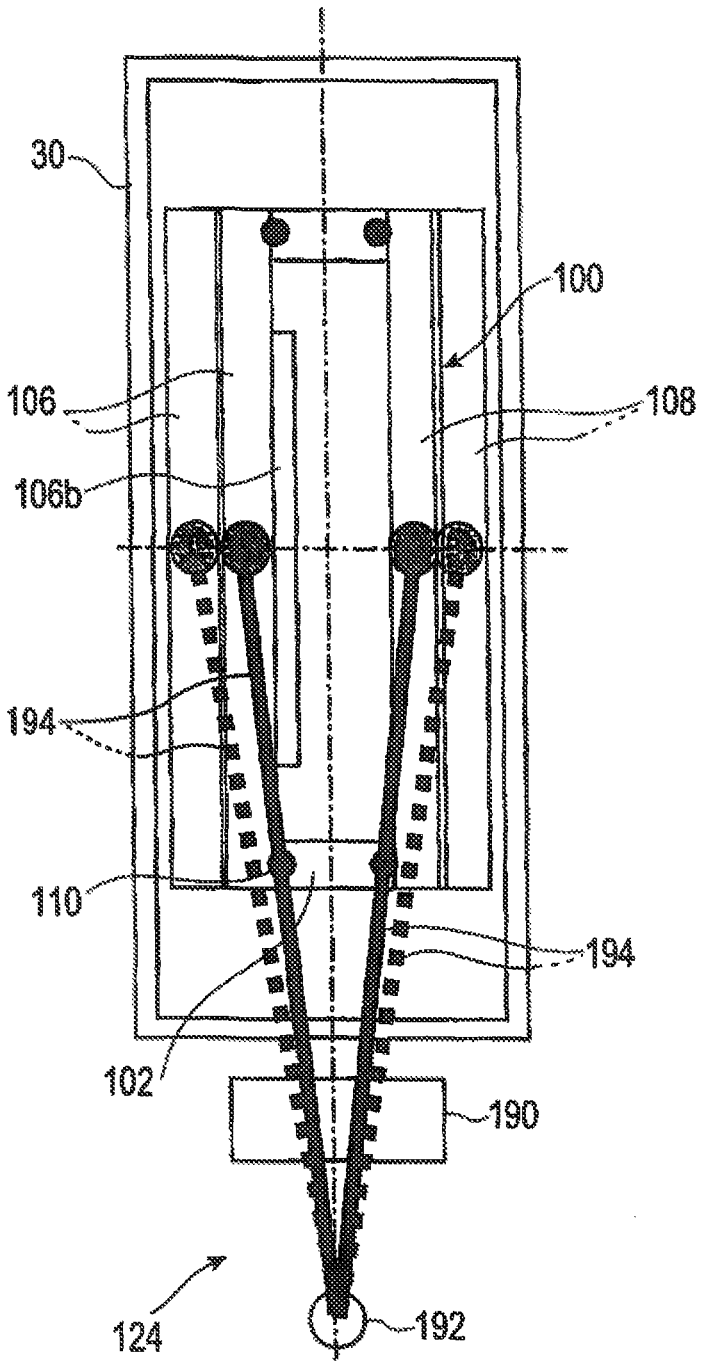
Figure 24:
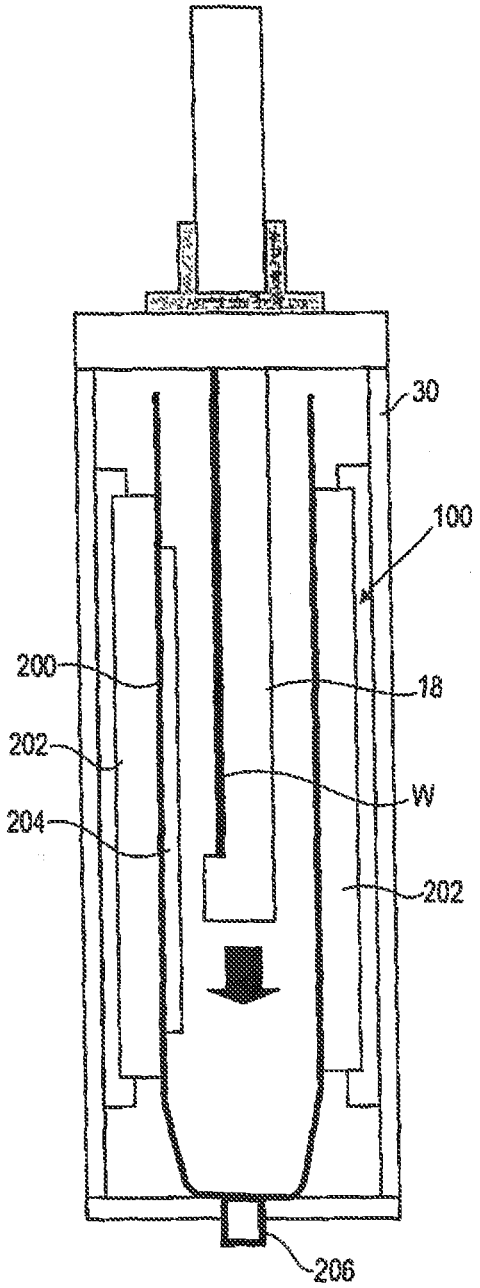
Figure 25:
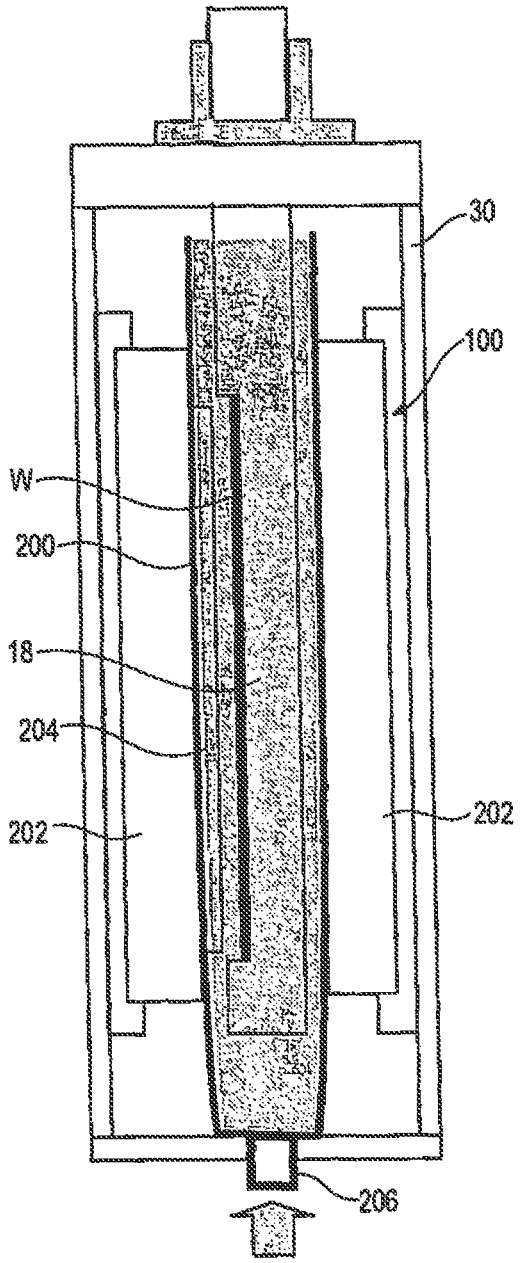
Figure 26:
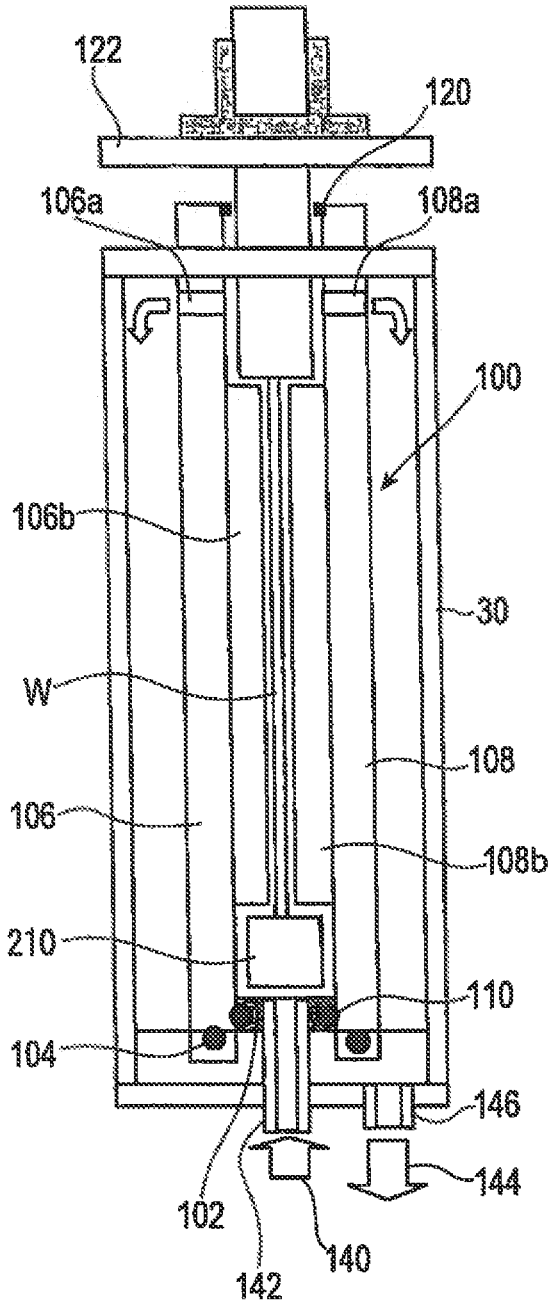
Figure 27:
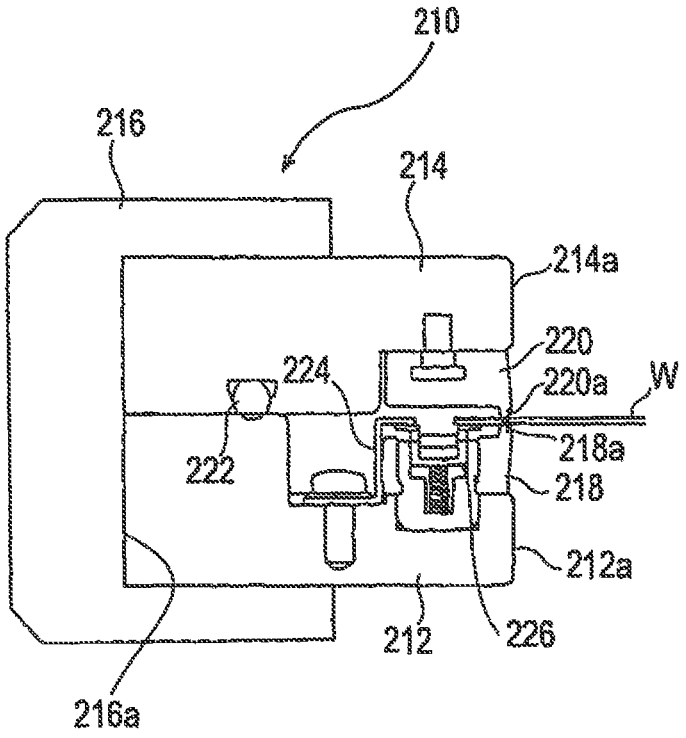
Figure 28:
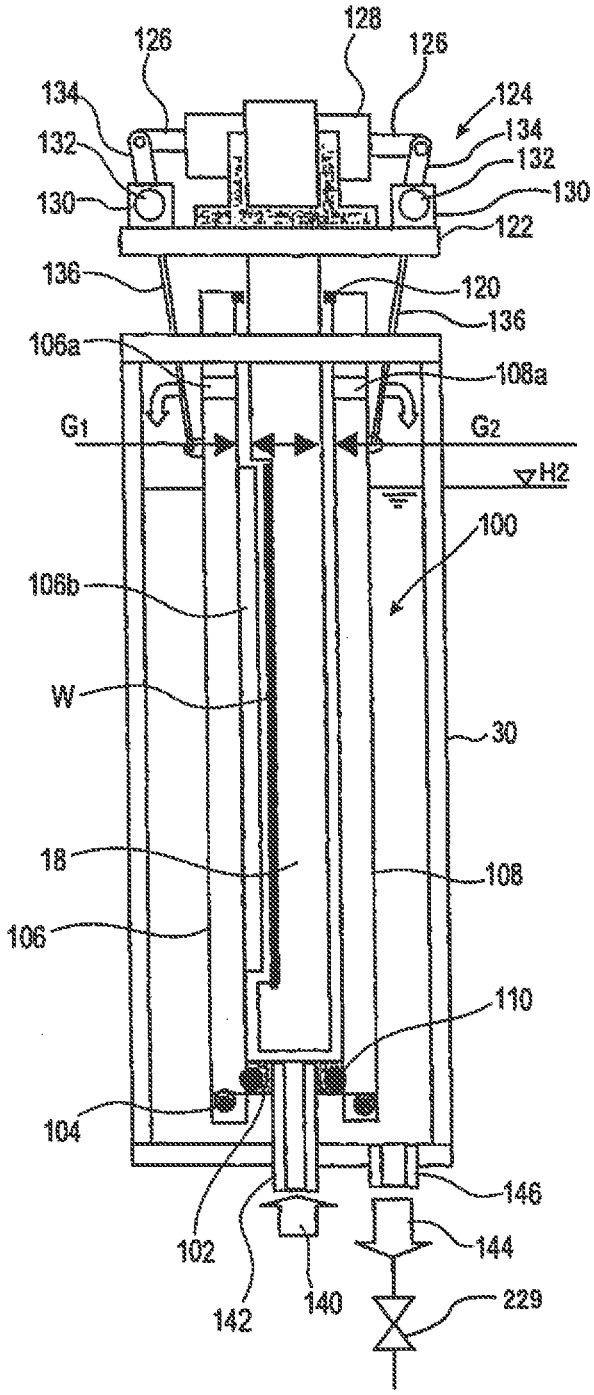
Figure 29:
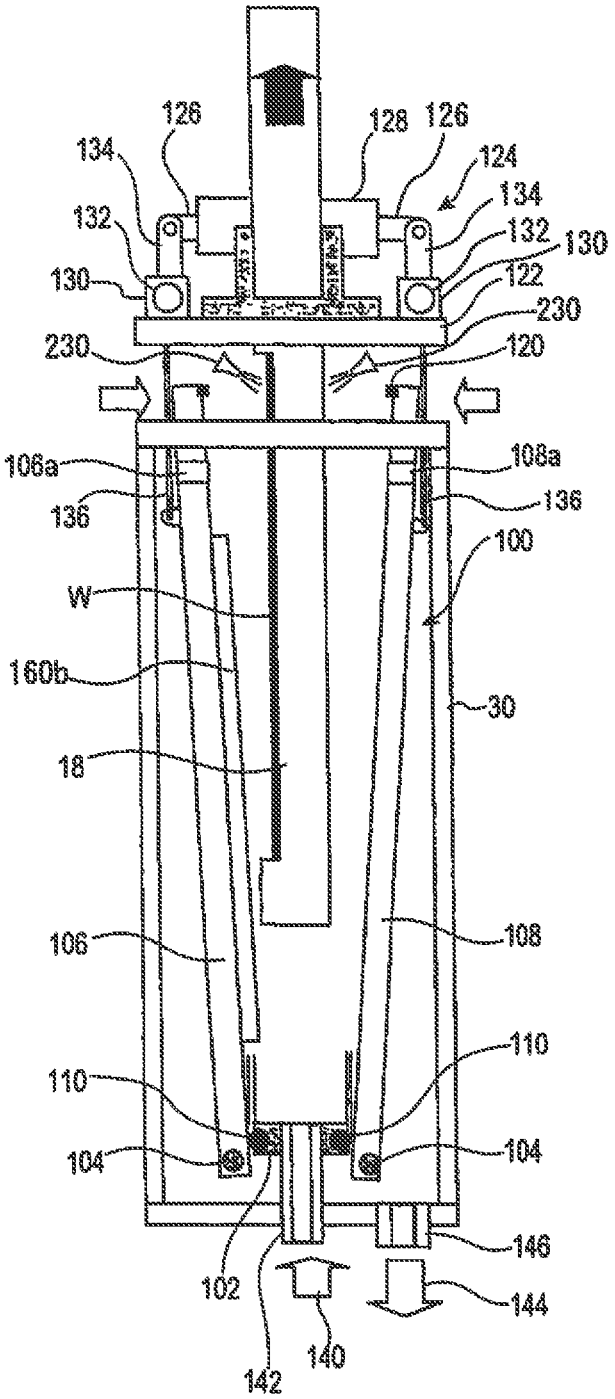
Figure 30:
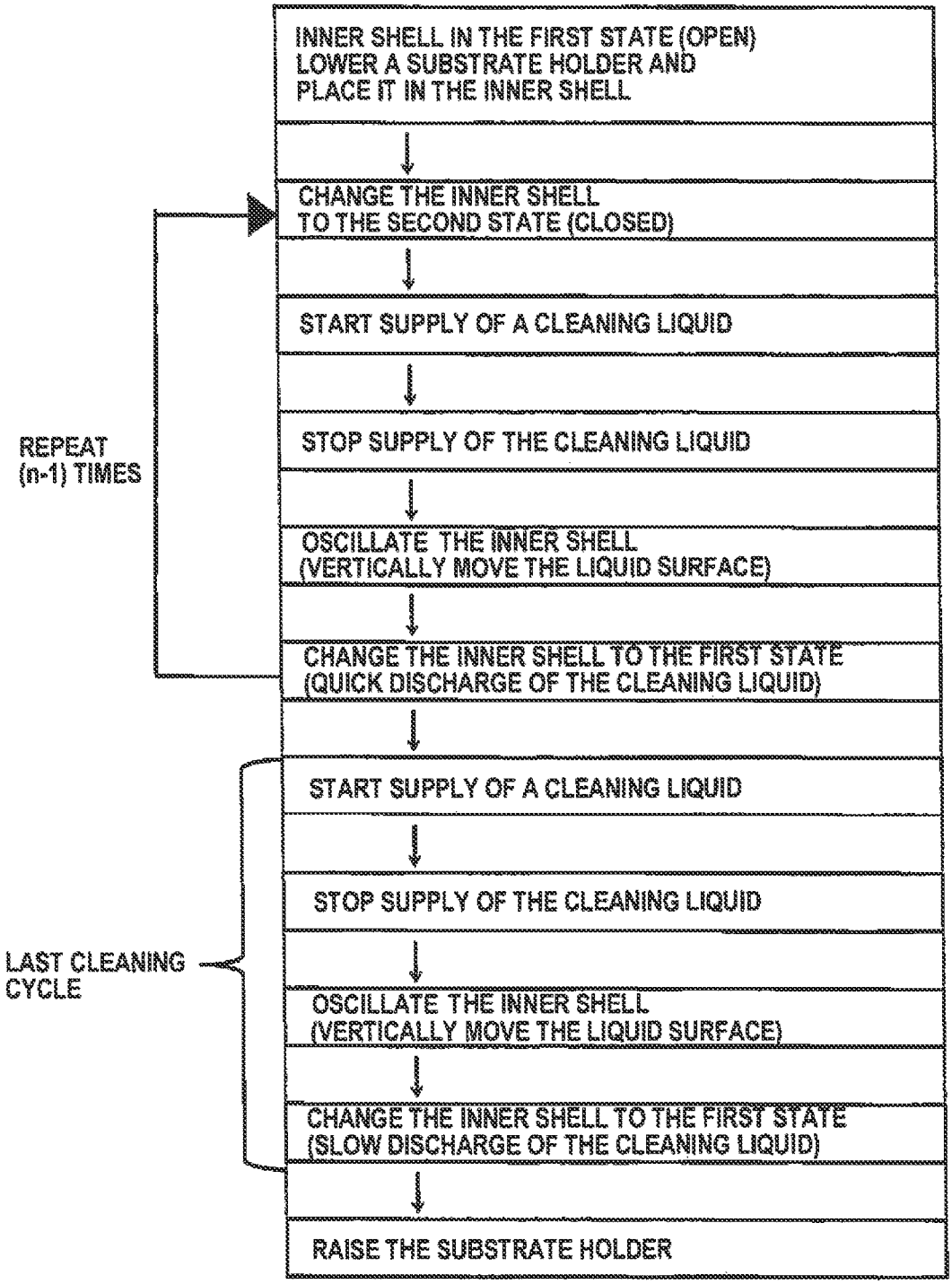

FIG. 11 is a schematic view of a cleaning bath according to another embodiment;

FIG. 12 is a schematic view of a cleaning bath according to yet another embodiment;

FIG. 13 is a diagram illustrating varying positions of a shell end plate when it is opened, closed, and oscillating;

FIG. 14 is a graph showing a relationship between the position of the shell and plate and time when the shell end plate is opened, closed, and oscillating;

FIG. 15 is a schematic view of a cleaning bath according to yet another embodiment;

FIG. 16 is a schematic view of a cleaning bath according to yet another embodiment;

FIG. 17 is a schematic view of a cleaning bath according to yet another embodiment;

FIG. 18 is a schematic view of a cleaning bath according to yet another embodiment;

FIG. 19 is a schematic view of a cleaning bath according to yet another embodiment;

FIG. 20 is a schematic view of a cleaning bath according to yet another embodiment;

FIG. 21 is a schematic view of a cleaning bath according to yet another embodiment;

FIG. 22 is a schematic view of a cleaning bath according to yet another embodiment;

FIG. 23 is a schematic view of a cleaning bath according to yet another embodiment;

FIG. 24 is a schematic view of a cleaning bath according to yet another embodiment, illustrating the cleaning bath when a substrate holder, holding a substrate, is placed at a predetermined position in the cleaning bath;

FIG. 25 is a schematic view of the cleaning bath when cleaning the substrate and the substrate holder set at the predetermined position in the cleaning bath;

FIG. 26 is a schematic view of a cleaning bath according to yet another embodiment;

FIG. 27 is an enlarged view of a main portion of a substrate holder which is cleaned in the cleaning bath shown in FIG. 26;

FIG. 28 is a diagram illustrating an exemplary process of cleaning the interior of the cleaning bath by storing a cleaning liquid in the cleaning bath;

FIG. 29 is a schematic view of a cleaning bath according to yet another embodiment; and FIG. 30 shows a process sequence of a cleaning process intended to address a problem of an increased amount of cleaning liquid droplets adhering to a substrate or a substrate holder after cleaning.

DETAILED DESCRIPTION OF EMBODIMENTS

Embodiments will now be described with reference to the drawings. The same reference numerals are used in the following figures and descriptions to refer to the same or like elements, components, etc., and duplicate descriptions thereof will be omitted.

Figure 1:
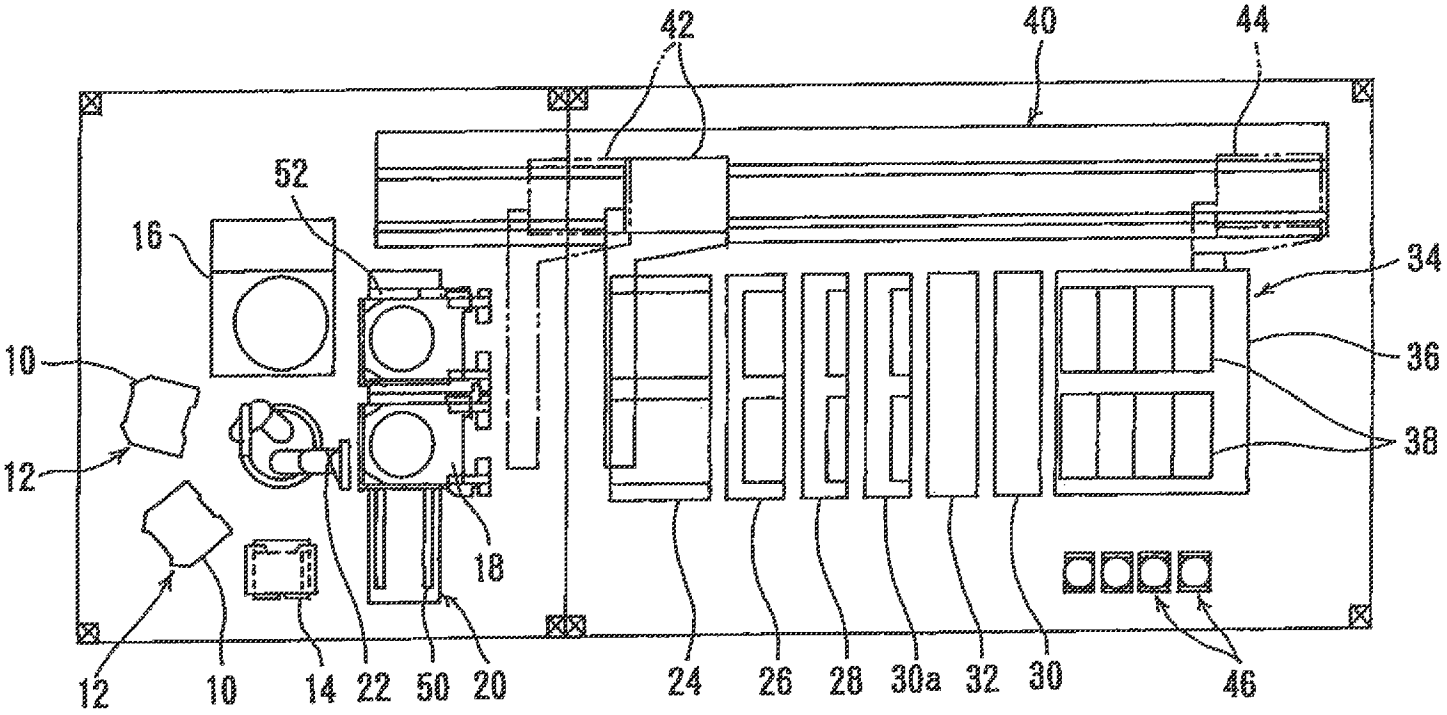
FIG. 1 is an overall layout plan view of a plating apparatus according to an embodiment.
Figure 2:
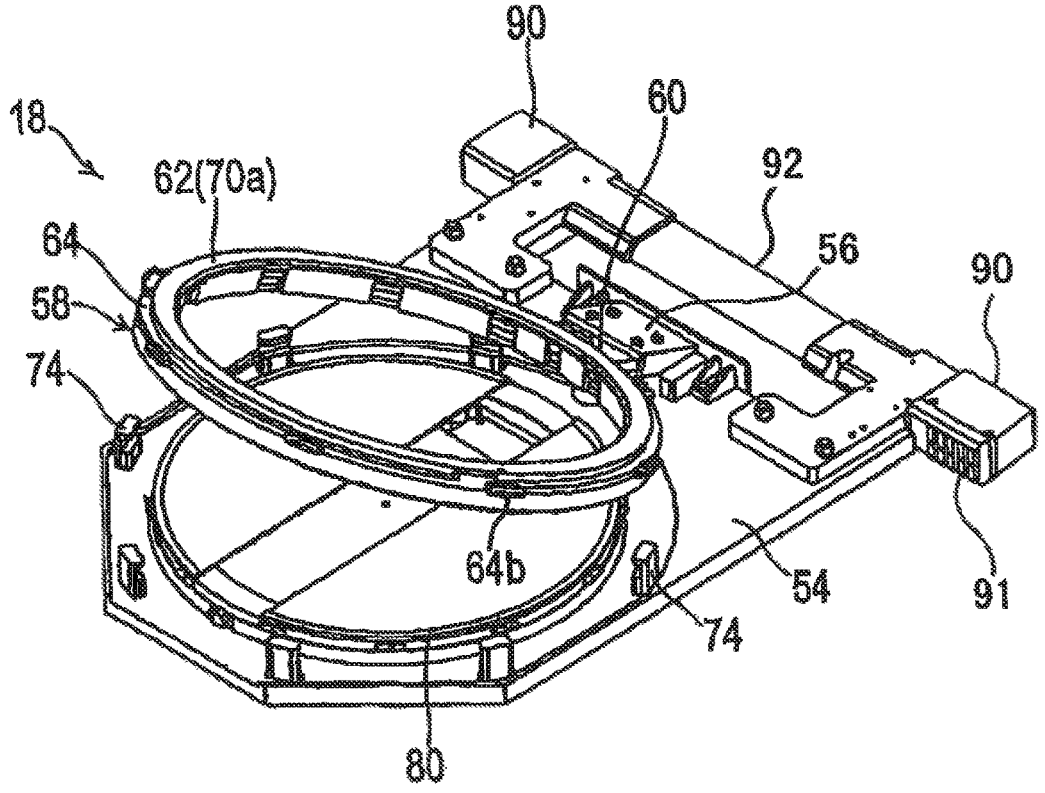
FIG. 2 is a perspective view of a substrate holder.

FIG. 1 shows an overall layout plan of a plating apparatus according to an embodiment. As shown in FIG. 1, the plating apparatus includes two cassette tables 12 on which substrate cassettes 10, each storing substrates, such as semiconductor wafers, are placed, an aligner 14 for aligning an orientation flat or a notch of a substrate in a predetermined direction, and a spin rinse drier 16 for drying a plated substrate by rotating it at a high speed. Near the spin rinse drier 16 is provided a substrate loading unit 20 for placing a substrate holder 18 thereon and loading the substrate into the substrate holder 18 and removing the substrate from the substrate holder 18. Further, in the center of these units 10, 14, 16, and 20 is disposed a substrate transport device 22 constituted by a transport robot for transporting the substrate between these units.

The substrate loading unit 20, a stocker 24 for storing (and temporarily storing) substrate holders 18 therein, a pee-wetting bath 26 for immersing the substrate in pure water, a pre-soaking bath 28 for etching away an oxide film formed on a surface of a film (e.g., a seed layer) of the substrate, a first cleaning bath 30*a* for cleaning the surface of the pre-soaked substrate, together with the substrate holder 18, with a cleaning liquid (e.g., pure water), a blow bath 32 for removing the cleaning liquid from the cleaned substrate, a second cleaning bath 30 for cleaning the plated substrate, together with the substrate holder 18, with a cleaning liquid (e.g., pure water), and a plating bath 34 are arranged in this order. The plating bath 34 includes an overflow bath 36 and a plurality of plating cells 38 surrounded by the overflow bath 36. Each plating cell 38 is configured to receive one substrate therein and perform plating, e.g., copper plating, on the surface of the substrate.

Located lateral to the above baths, there is provided a substrate holder transport device 40, driven e.g., by a linear motor, for transporting the substrate holder 18, together with a substrate, between the baths. The substrate holder transport device 40 has a first transporter 42 for transporting a substrate between the substrate loading unit 20, the stocker 24, the pre-wetting bath 26, the pre-soaking bath 28, the first cleaning bath 30*a*, and the blow bath 32, and a second transporter 44 for transporting the substrate between the first cleaning baths 30*a*, the second cleaning bath 30, the blow bath 32, and the plating bath 34. The substrate holder transport device 40 may be provided with only the first transporter 42 without being provided with the second transporter 44.

Paddle drive devices 46 are provided each for driving a paddle (not shown) disposed in each plating cell 38 as an agitator for agitating a plating solution in the plating cell 38. The paddle drive devices 46 are located beside the overflow bath 36 at the opposite side of the substrate holder transport device 40.

The substrate loading unit 20 includes a flat stage plate 52 which is laterally slidable along rails 50. Two substrate holders 18, parallel to each other, are placed horizontally on the stage plate 52. One substrate is transferred between one substrate holder 18 and the substrate transport device 22, and then the stage plate 52 is slid laterally so that the other substrate is transferred between the other substrate holder 18 and the substrate transport device 22.

As shown in FIGS. 2 through 5, the substrate holder 18 includes a first holding member (or a base holding member) 54 having a rectangular plate shape and made of e.g., vinyl chloride, and a second holding member (or a movable holding member) 58 rotatably coupled to the first holding member 54 through a hinge 56 which allows the second holding member 58 to open and close with respect to the first holding member 54. While the second holding member 58 is configured to be openable and closable through the hinge 56 in this embodiment, it is also possible to dispose the second holding member 58 opposite to the first holding member 54 and to move the second holding member 58 away from and toward the first holding member 54 to thereby open and close the second holding member 58.

The second holding member 58 includes a base portion 60 and a ring-shaped seal holder 62. The seal holder 62 is made of vinyl chloride so as to enable a retaining ring 64, which will be described later, to slide well. An annular substrate-side sealing member 66 is fixed to an upper portion of the seal holder 62. This substrate-side sealing member 66 is placed in pressure contact with a periphery of the surface of the substrate W to seal a gap between the substrate W and the second holding member 58 when the substrate W is held by the substrate holder 18. An annular holder-side sealing member 68 is fixed to a surface, facing the first holding member 54, of the seal holder 62. This holder-side sealing member 68 is placed in pressure contact with the first holding member 54 to seal a gap between the first holding member 54 and the second holding member 58. The holder-side sealing member 68 is located at the outer side of the substrate-side sealing member 66.

Figure 5:
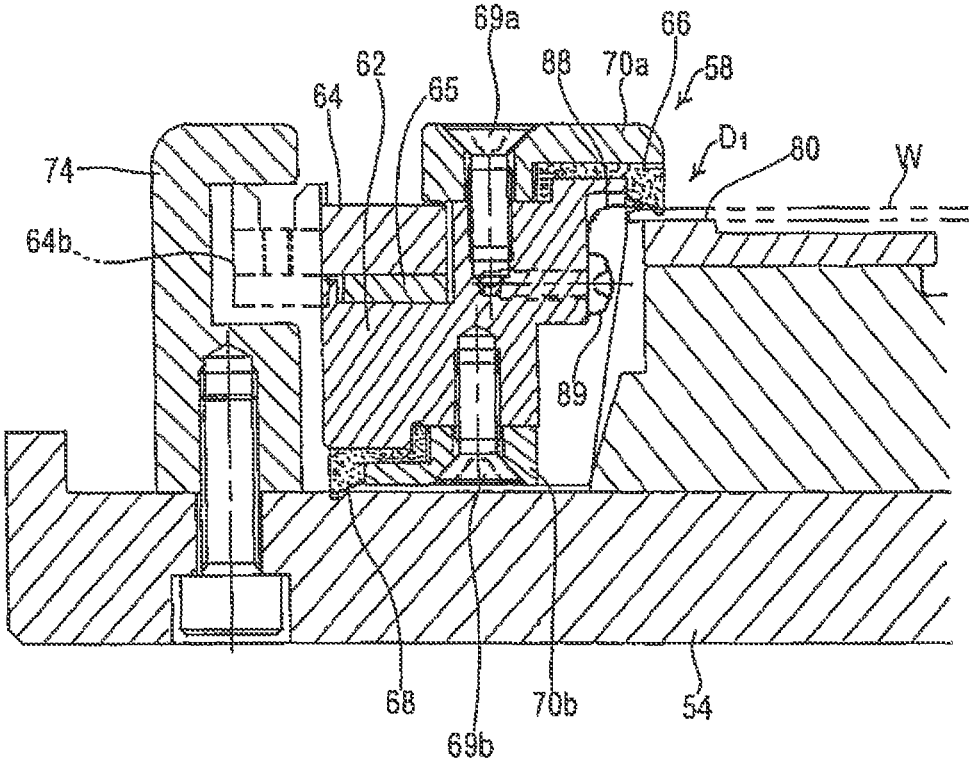
FIG. 5 is an enlarged view of the portion A of FIG. 4.

As shown in FIG. 5, the substrate-side sealing member 66 is sandwiched between the seal holder 62 and a first mounting ring 70*a*, which is secured to the seal holder 62 by fastening tools 69*a*, such as screws. The holder-side sealing member 68 is sandwiched between the seal holder 62 and a second mounting ring 70*b*, which is secured to the seal holder 62 by fastening tools 69*b*, such as screws.

The seal holder 62 has a stepped portion at a periphery thereof, and the retaining ring 64 is rotatably mounted to the stepped portion through a spacer 65. The retaining ring 64 is inescapably held by an outer peripheral portion of the first mounting ring 70*a*. This retaining ring 64 is made of a material (e.g., titanium) having high rigidity and excellent acid and alkali corrosion resistance and the spacer 65 is made of a material having a low friction coefficient, for example PTFE, so that the retaining ring 64 can rotate smoothly.

Inverted L-shaped clampers 74, each having an inwardly projecting portion and located at the outer side of the retaining ring 64, are provided on the first holding member 54 at equal intervals along a circumferential direction of the retaining ring 64. The retaining ring 64 has, on its outer circumferential surface, outwardly projecting portions 64*b* arranged at positions corresponding to positions of the clampers 74. A lower surface of the inwardly projecting portion of each clamper 74 and an upper surface of each projecting portion 64*b* of the retaining ring 64 are inclined in opposite directions along the rotational direction of the retaining ring 64. A plurality (e.g., three) of upwardly projecting protrusions 64*a* are provided on the retaining ring 64 at predetermined positions along the circumferential direction of the retaining ring 64. The retaining ring 64 can be rotated by pushing and moving each protrusion 64*a* from a lateral direction by means of a rotating pin (not shown).

With the second holding member 58 open, the substrate W is inserted into the central portion of the first holding member 54, and the second holding member 58 is then closed through the hinge 56. Subsequently the retaining ring 64 is rotated clockwise so that each projecting portion 64*b* of the retaining ring 64 slides into the inwardly projecting portion of each clamper 74. As a result, the first holding member 54 and the second holding member 58 are fastened to each other and locked by engagement between the inclined surfaces of the retaining ring 64 and the inclined surfaces of the clampers 74. The lock of the second holding member 58 can be released by rotating the retaining ring 64 counterclockwise to disengage the projecting portions 64*b* of the retaining ring 64 from the inverted L-shaped clampers 74. When the second holding member 58 is locked in the above-described manner, the downwardly-protruding portion of the substrate-side sealing member 66 is placed in pressure contact with the periphery of the surface of the substrate W. The substrate-side sealing member 66 is pressed uniformly against the substrate W to thereby seal the gap between the periphery of the surface of the substrate W and the second holding member 58. Similarly, when the second holding member 58 is locked, the downwardly-protruding portion of the holder-side sealing member 68 is placed in pressure contact with the surface of the first holding member 54. The sealing holder-side sealing member 68 is uniformly pressed against the first holding member 54 to thereby seal the gap between the first holding member 54 and the second holding member 58.

When the substrate-side sealing member 66 is pressed against the periphery of the surface of the substrate W to establish the sealed state, a stepped portion in a ring shape is formed between the surface of the substrate W and an inner circumferential surface of the substrate-side sealing member 66. This stepped portion extends continuously along a contact portion $D_1$ of the periphery of the surface of the substrate W that contacts the substrate-side sealing member 66, i.e., along a seal surface of the substrate-side sealing member 66. With the substrate-side sealing member 66 in contact with the periphery of the surface of the substrate W, the substrate W is immersed together with the substrate holder 18 in the plating solution held in the plating unit 38, and then the substrate W is plated. After plating of the substrate W, the substrate holder 18 is raised from the plating unit 38. At this time, the plating solution is liable to remain on the contact portion $D_1$. As will be described later, the cleaning bath is configured to clean the substrate holder 18, holding the substrate W, so that the plating solution remaining on the contact portion $D_1$ can be removed (or cleaned) efficiently.

A protruding portion 82 is formed on the upper surface of the first holding member 54 so as to protrude in a ring shape with a size corresponding to a size of the substrate W. The protruding portion 82 has an annular support surface 80 which contacts a periphery of the substrate W to support the substrate W. The protruding portion 82 has recesses 84 arranged at predetermined positions along a circumferential direction of the protruding portion 82.

A pair of outwardly-projecting holder hangers 90 is provided on the ends of the first holding member 54 of the substrate holder 18. These holder hangers 90 serve as a support when the substrate holder 18 is transported and when the substrate holder 18 is supported in a suspended state. A hand lever 92 extends between the holder hangers 90 on both sides. The substrate holder transport device 40 is configured to grip the hand lever 92 to thereby hold the substrate holder 18. In the stocker 24, the holder hangers 90 are placed on an upper surface of a surrounding wall of the stocker 24, whereby the substrate holder 18 is suspended in a vertical position. When transporting the substrate holder 18 from the stocker 24, the holder hangers 90 of the suspended substrate holder 18 are gripped by the first transporter 42 of the substrate holder transport device 40. Also in the pre-wetting bath 26, the pre-soaking bath 28, the cleaning baths 30*a* and 30, the blow bath 32, and the plating bath 34, the substrate holder 18 is held in a suspended state with the holder hangers 90 placed on a surrounding wall of the bath.

Figure 3:
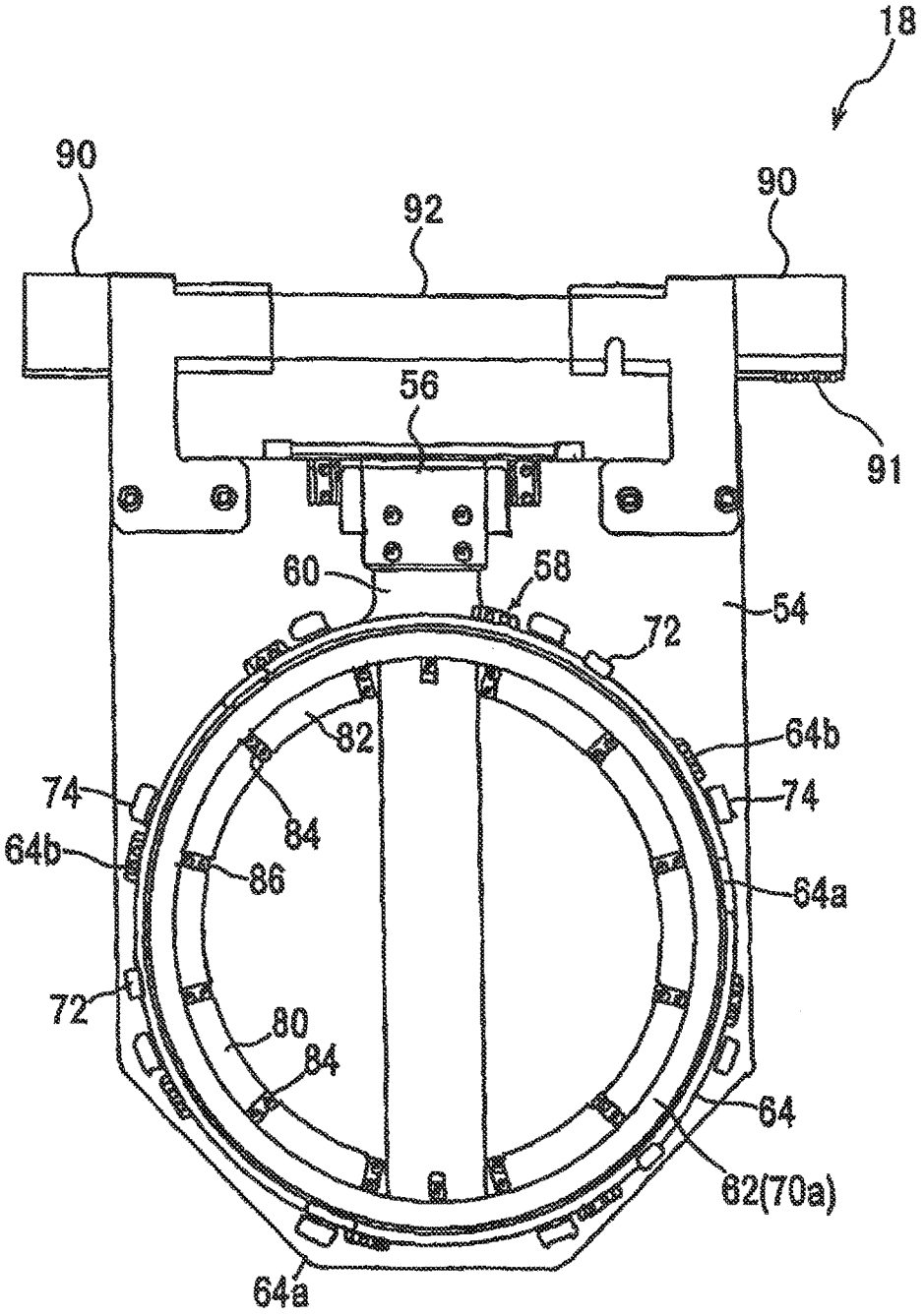
FIG. 3 is a plan view of the substrate holder shown in FIG. 2.
Figure 4:
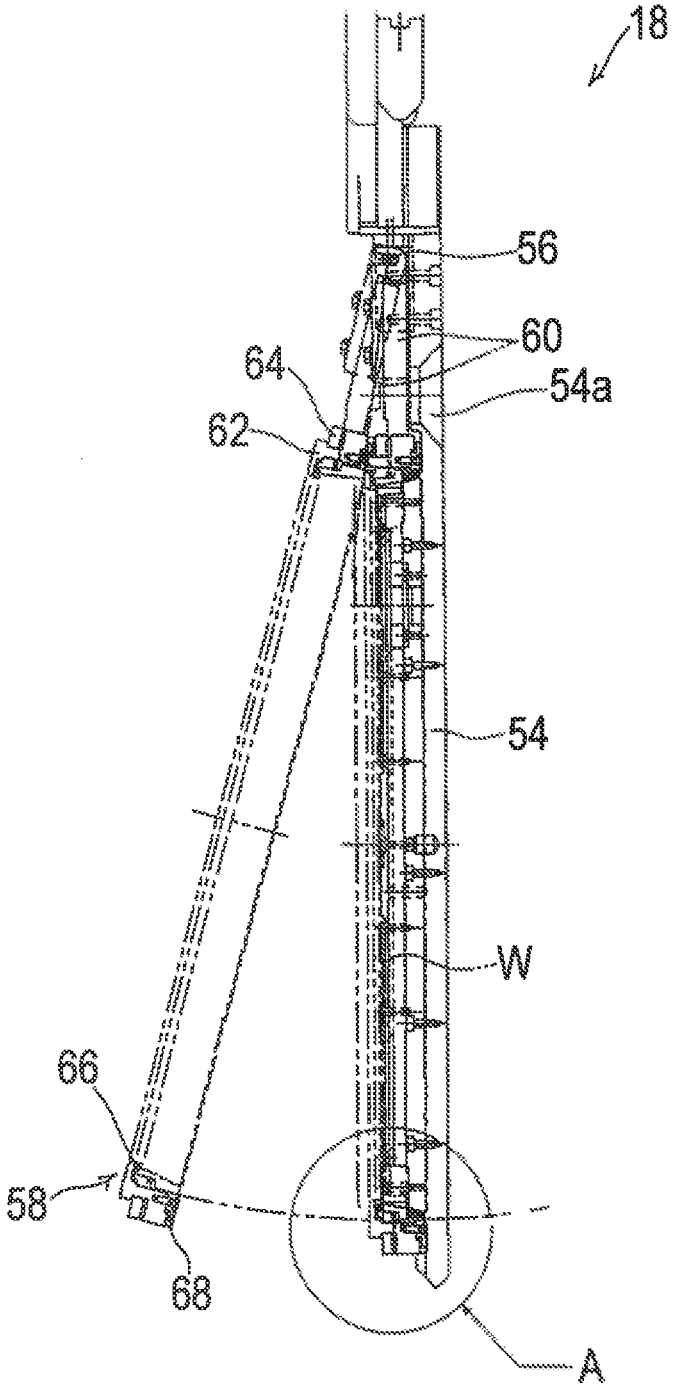
FIG. 4 is a right side view of the substrate holder shown in FIG. 2.

As shown in FIG. 3, a plurality of (e.g., 12 as illustrated) electrical conductors (electrical contacts) 86 are disposed in the recesses 84, respectively. These electrical conductors 86 are coupled respectively to wires extending from connecting terminals 91 provided on the holder hanger 90. The electrical conductors 86 have their end portions, respectively, which are located outwardly of the periphery of the substrate W so that the electrical conductors 86 themselves do not contact the substrate W. When the substrate W is placed on the support surface 80 of the first holding member 54, the end portions of the electrical conductors 86 spring out around the substrate W to resiliently contact lower portions of electrical contacts 88 shown in FIG. 5.

The electrical contacts 88, which are to be electrically connected to the electrical conductors 86, are secured to the seal holder 62 of the second holding member 58 by fastening tools 89, such as screws. Each of the electrical contacts 88 has a leaf spring-like contact portion located at the outer side of the substrate-side sealing member 66 and projecting inwardly. This spring-like contact portion is springy and bends easily. When the substrate W is held by the first holding member 54 and the second holding member 58, the contact portions of the electrical contacts 88 come into elastic contact with the peripheral surface of the substrate W supported on the support surface 80 of the first holding member 54.

The second holding member 58 is opened and closed by a not-shown pneumatic cylinder and by a weight of the second holding member 58 itself. More specifically, the first holding member 54 has a through-hole 54*a*, and a pneumatic cylinder is provided so as to face the through-hole 54*a* when the substrate holder 18 is placed on the stage plate 52. The second holding member 58 is opened by extending a piston rod of the pneumatic cylinder through the through-hole 54*a* to push up the seal holder 62 of the second holding member 58 through a pushing rod. The second holding member 58 is closed by its own weight when the piston rod is retracted.

Next, the second cleaning bath 30 for cleaning a plated substrate W, together with the substrate holder 18, with a cleaning liquid (e.g., pure water) will be described in detail. The first cleaning bath 30*a* for cleaning a pre-soaked substrate, together with the substrate holder 18, with a cleaning liquid may have the same structure as the second cleaning bath 30.

Figure 6:
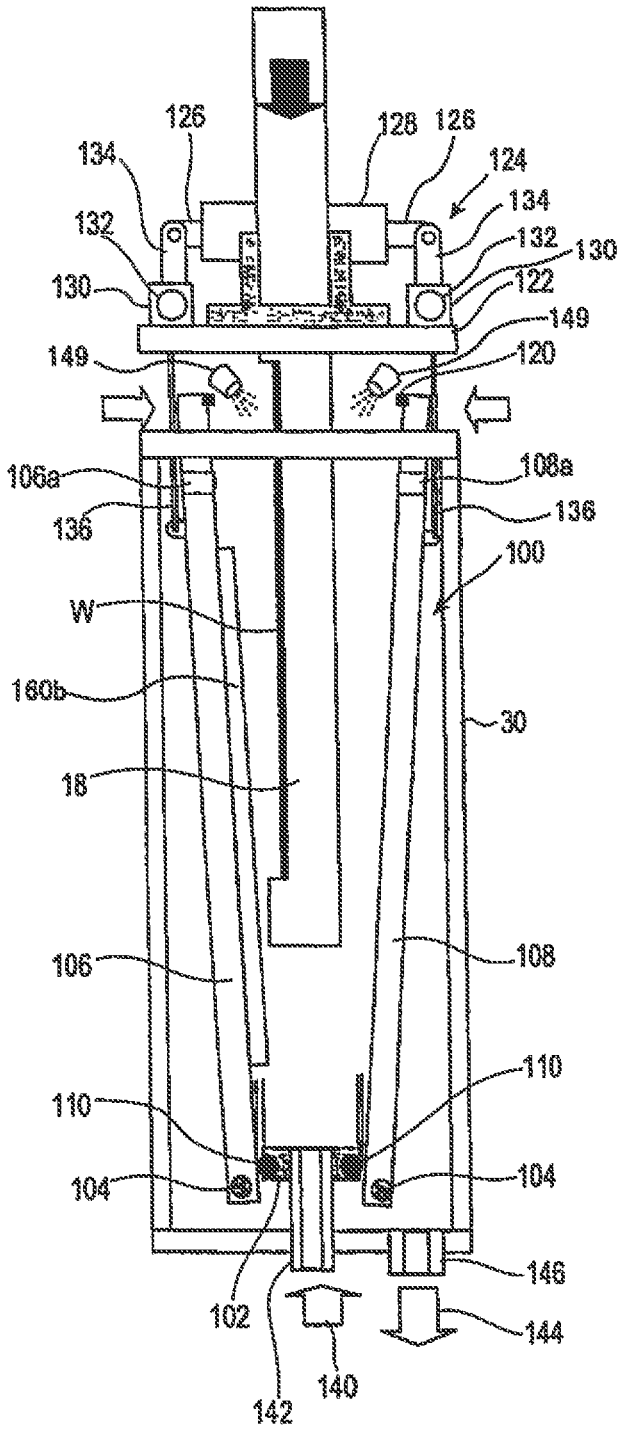
FIG. 6 is a vertical cross-sectional front view of a cleaning bath according to an embodiment, illustrating the cleaning bath when a substrate holder, holding a substrate, is placed at a predetermined position in the cleaning bath.
Figure 7:
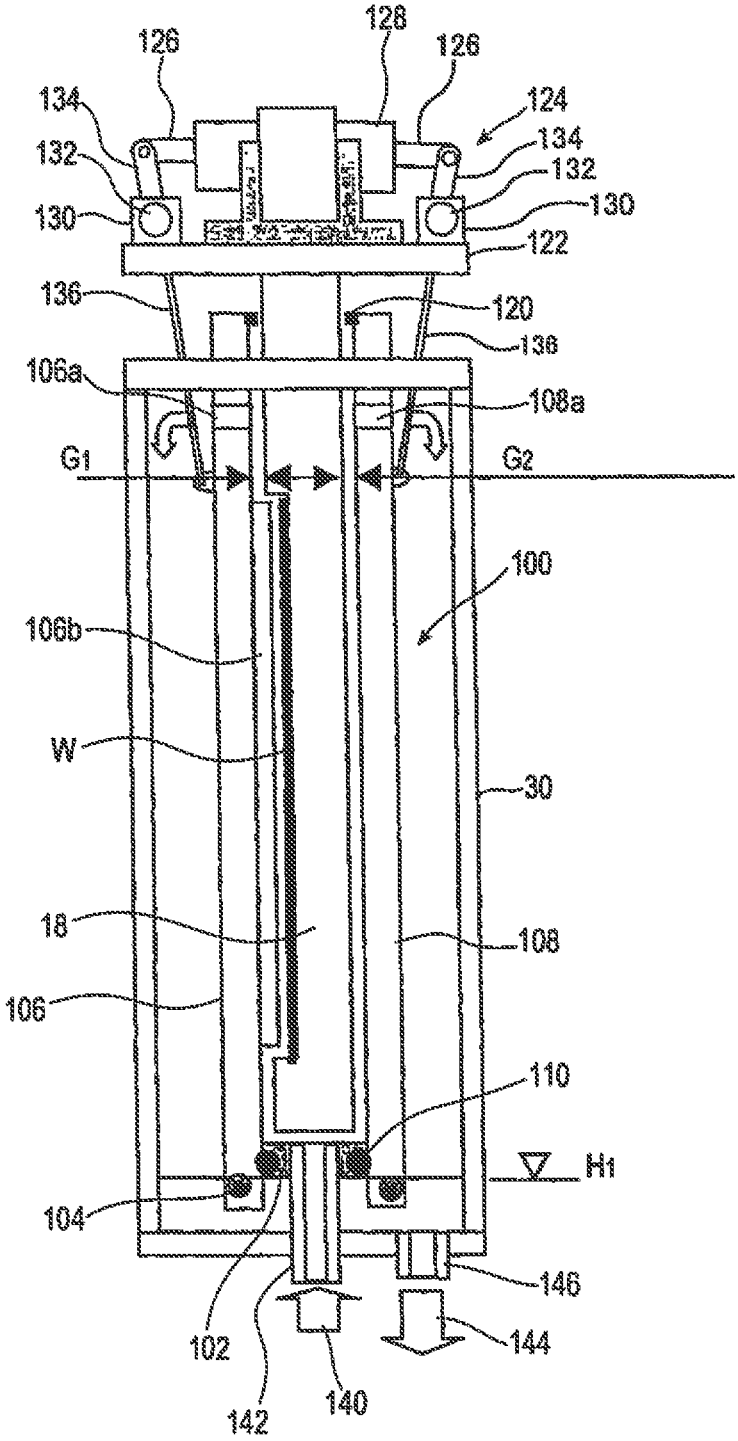
FIG. 7 is a vertical cross-sectional front view of the cleaning bath when cleaning the substrate and the substrate holder set at the predetermined position in the cleaning bath.

FIG. 6 is a vertical cross-sectional front view of the second cleaning bath (hereinafter referred to simply as cleaning bath) 30, illustrating the cleaning bath 30 when the substrate holder 18, holding a substrate W, is placed at a predetermined position in the cleaning bath 30. FIG. 7 is a vertical cross-sectional front view of the cleaning bath 30 when cleaning the substrate W and the substrate holder 18 set at the predetermined position in the cleaning bath 30.

As shown in FIGS. 6 and 7, the cleaning bath 30 has a shape of an open-top box. An openable and closable open-top inner shell 100 is installed in the cleaning bath 30. The inner shell 100 is configured to be transformed selectively into a first state (an opened state shown in FIG. 6), in which the substrate holder 18 holding the substrate W is placed at the predetermined position, and a second state (a closed state shown in FIG. 7) in which the substrate holder 18, except its top portion, is hermetically enclosed by the inner shell 100. As shown in FIG. 7, the inner shell 100 has an inner surface having a configuration that follows an uneven exterior configuration of the substrate holder 18 holding the substrate W so that when the inner shell 100 is closed, the inner surface of the inner shell 100 is placed in proximity to the substrate holder 18 and the substrate W.

The inner shell 100 includes a shell side plate 102 and a pair of flat plate-like shell end plates 10, 108 disposed at both sides of the shell side plate 102. The shell end plates 106, 108 are rotatably coupled to the shell side plate 102 by hinges 104. The one shell end plate 106 is located at a side of the front surface of the substrate holder 18 so as to face the substrate W held by the substrate holder 18, while the other shell end plate 108 is located at a side of the back surface of the substrate holder 18. The inner shell 100 can be transformed into the first state when the shell end plates 106, 108 are opened, and can be transformed into the second state when the shell end plates 106, 108 are closed.

Figure 8:
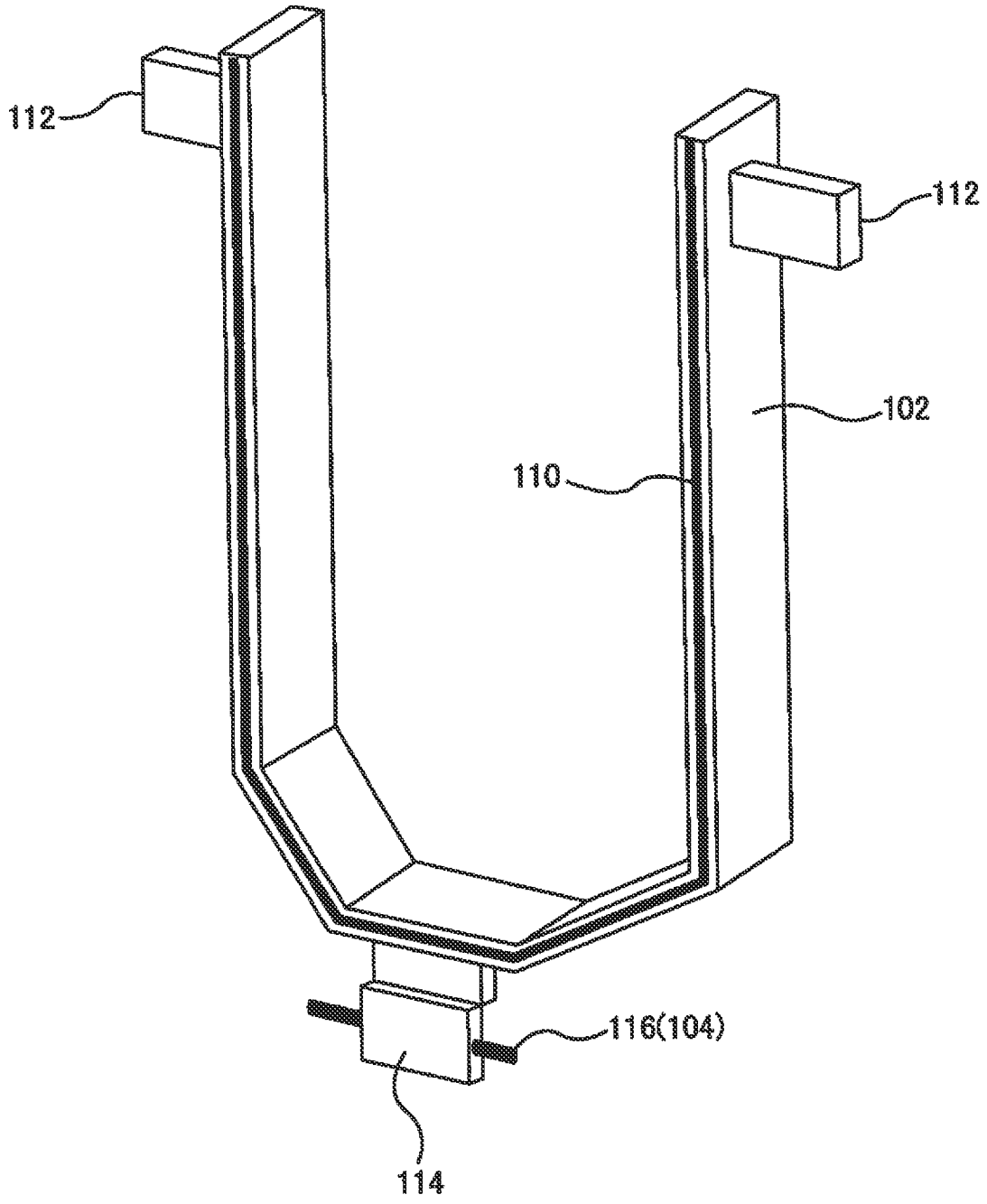
FIG. 8 is a perspective view of a shell side plate.

FIG. 8 is a perspective view of the shell side plate 102. As shown in FIG. 8, the shell side plate 102 has a U-shape which surrounds both side portions and a bottom portion of the substrate holder 18, and has its upper ends reaching the top of the cleaning bath 30. The shell side plate 102 has end surfaces that face the shell end plates 106, 108. To each end surface is attached a sealing member 110 which extends along the end surface. A silicone tube, having an inner diameter of 2 mm and an outer diameter of 3 mm, may be used as the sealing member 110. The use of such a silicone tube can prevent a lowering of the scaling performance of the sealing member 110 even when the shell end plates 106, 108 move toward the shell side plate 102 in the closing direction within a distance of about 0.1 mm, as will be described later. The sealing member 110 may have any different shape and may be made of any different material so long as the intended sealing performance is ensured.

Side supports 112 and a lower support 114 are mounted respectively to side portions and a lower portion of the shell side plate 102. The shell side plate 102 is fixed at a predetermined position in the cleaning bath 30 through the side supports 112 and the lower support 114. A hinge pin 116, constituting a hinge 104, is mounted to the lower support 114.

Figure 9:
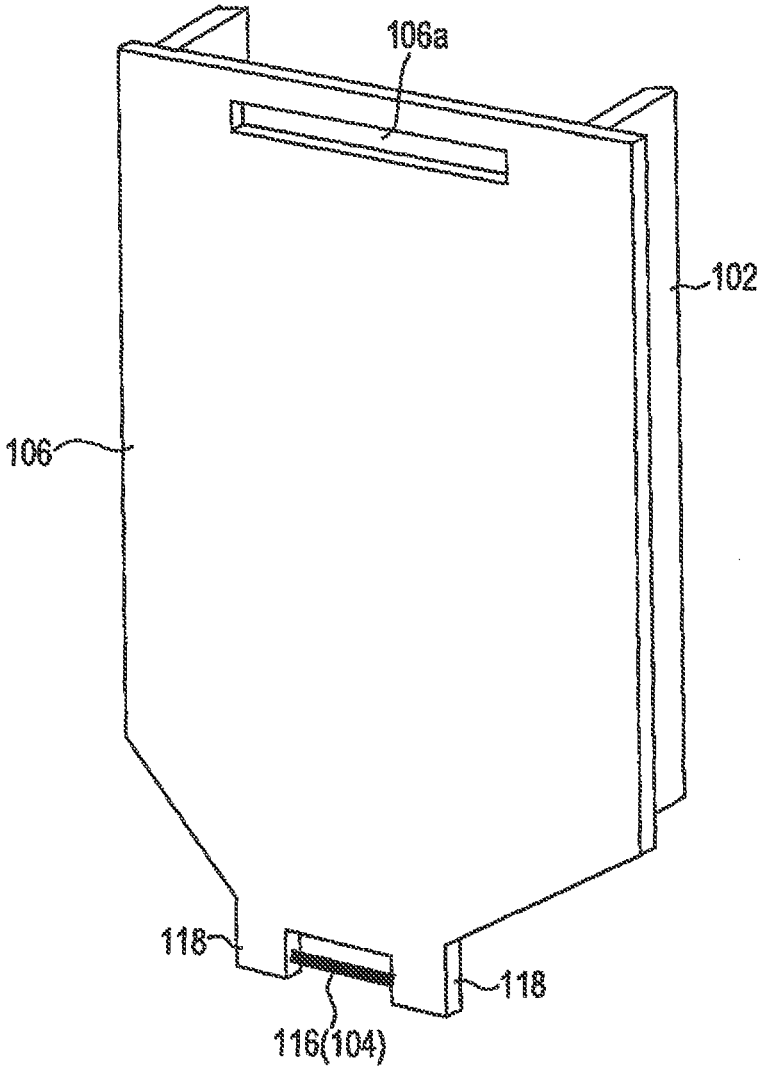
FIG. 9 is a perspective view of a shell end plate disposed beside the shell side plate.

FIG. 9 is a perspective view of the shell end plate 106 disposed beside the shell side plate 102. The shell end plate 106 is formed of, for example, a composite material including an inner layer of polyvinyl chloride and an outer reinforcing layer of stainless steel so that the shell end plate 106 can be made thin and can have a sufficient rigidity. The shell end plate 106 has a shape that covers the entire end surface of the U-shaped shell side plate 102. The shell end plate 106 has a rectangular overflow hole 106*a* at an upper portion thereof. A pair of projecting portions 118, projecting downward, is formed on a bottom of the shell end plate 106. The hinge pin 116, mounted to the lower support 114, is loosely inserted into the projecting portions 118, thus constituting the hinge 104 which couples the shell end plate 106 to the shell side plate 102 while allowing the shell end plate 106 to be opened and closed.

The above-discussed construction of the hinge 104 is substantially the same as that of the other shell end plate 108. The shell end plate 108 has a rectangular overflow hole 108*a* at an upper portion thereof (see FIGS. 6 and 7). In order to prevent overflow of a cleaning liquid, the shell end plates 106, 108 each have a simple seal 120 (see FIGS. 6 and 7), provided at the upper end of the inner surface of each plate, to seal gaps between the substrate holder 18 and the shell end plates 106, 108 when the shell end plates 106, 108 are closed.

As shown in FIGS. 6 and 7, the cleaning bath 30 is provided with a lid 122. The lid 122 is provided with an opening and closing mechanism 124 for opening and closing the shell end plates 106, 108. The lid 122 has a shape that does not interfere with a vertical movement of the substrate holder 18. The opening and closing mechanism 124 includes an actuator (e.g., air chuck) 128 for simultaneously moving, in opposite directions, a pair of open-close rods 126 extending approximately horizontally, and a pair of support shafts 132 rotatably supported by brackets 130. Each support shaft 132 extends approximately horizontally and is perpendicular to the corresponding open-close rod 126. Upwardly-extending connecting arms 134 are secured to the support shafts 132, respectively, and upper ends of the connecting arms 134 are rotatably coupled to the open-close rods 126. Downwardly-extending operating arms 136 are secured to the support shafts 132, respectively, and lower ends of the operating arms 136 are rotatably coupled to the shell end plates 106, 108, respectively.

As the open-close rods 126 are moved in directions away from each other (i.e., outwardly), the inner shell 100 changes from the first state in which the shell end plates 106, 108 are opened, shown in FIG. 6, to the second state in which the shell end plates 106, 108 are closed, shown in FIG. 7. In conjunction with the movement of the open-close rods 126, the support shafts 132 are rotated by the connecting arms 134, whereby the operating arms 136 pivot on the support shafts 132 to cause the shell end plates 106, 108 to pivot (rotate) on the hinge 104 in directions closer to each other. When the open-close rods 126 are moved in directions closer to each other (i.e., inwardly), the shell end plates 106, 108 pivot (rotate) on the hinge 104 in directions away from each other. Consequently, the inner shell 100 changes from the second state in which the shell end plates 106, 108 are closed, shown in FIG. 7, to the first state in which the shell end plates 106, 108 are opened, shown in FIG. 6.

When the inner shell 100 is in the first state in which the shell end plates 106, 108 are opened, the substrate holder 18, holding the substrate W, can be lowered without contact with the inner shell 100 and placed at a predetermined position in the inner shell 100. When the inner shell 100 is in the second state in which the shell end plates 106, 108 are closed, the shell end plates 106, 108 are in pressure contact with the sealing members 110 so that portions of the inner shell 100 other than the top portion, i.e., the side and bottom portions of the inner shell 100, are liquid-tightly sealed with the sealing members 110. The inner surface of the inner shell 100 has the configuration that follows the uneven exterior configuration of the substrate holder 18 holding the substrate W.

As shown in FIG. 5, the front surface side of the substrate holder 18, holding the substrate W, has the uneven exterior configuration defined by the first holding member 54, the second holding member 58, the clampers 74, the substrate W, etc. As shown in FIG. 7, an uneven portion 106*b*, which follows the corresponding uneven exterior configuration of the substrate holder 18, is formed on the inner surface of the shell end plate 106 located on the side of the front surface of the substrate holder 18. Since the back surface side of the substrate holder 18 is approximately flat, the shell end plate 108, located at the back surface side of the substrate holder 18, has a flat inner surface. A gap G1 between the substrate holder 18 and the shell end plate 106 is set to 1 mm to 5 mm, preferably 1.5 mm to 2 mm. A gap G2 between the substrate holder 18 and the shell end plate 108 is set to 1 mm to 5 mm, preferably 1 mm to 1.5 mm.

The shell end plate 106 rotates about the hinge 104 provided at the bottom thereof. Accordingly, even when the shell end plate 106 is opened, a portion of the shell end plate 106 which lies below the uneven portion 106*b* remains close to the substrate holder 18. Therefore, in order to avoid contact between the shell end plate 106 and the substrate holder 18, a cutout (not shown) is locally formed in the inner surface of the shell end plate 106 at a position below the uneven portion 106*b*.

The substrate W and the substrate holder 18 are cleaned with a cleaning liquid supplied into the inner shell 100 in the second state. The gap G1 between the substrate holder 18 and the shell end plate 106 and the gap G2 between the substrate holder 18 and the shell end plate 108 are determined based on an amount of the cleaning liquid used in one cleaning cycle (or one cleaning step) and a flow velocity of the cleaning liquid. As is known, the higher the flow velocity of the cleaning liquid is, the higher is the cleaning power. In this embodiment, in order to intensively clean the front surfaces of the substrate holder 18 and the substrate W, the cleaning liquid is preferably allowed to flow at a higher flow velocity along the front surfaces of the substrate holder 18 and the substrate W.

It is therefore preferred to set the gap G1 between the substrate holder 18 and the shell end plate 106 to be larger than the gap G2 between the substrate holder 18 and the shell end plate 108 (G1>G2). This can minimize the sum of the gap G1 and the gap G2 to thereby reduce the amount of the cleaning liquid used in one cleaning cycle, while reducing the resistance to the cleaning liquid flowing through the gap G1 between the substrate holder 18 and the shell end plate 106, thereby increasing the flow velocity of the cleaning liquid flowing through the gap G1. An uneven configuration may be provided on the back surface of the substrate holder 18 and/or the inner surface of the shell end plate 108 so as to increase the resistance to the cleaning liquid flowing through the gap G2.

The cleaning bath 30, at its bottom, is provided with a cleaning liquid supply pipe (or a cleaning liquid supply conduit) 142 and a cleaning liquid discharge pipe 146. The cleaning liquid supply pipe 142 penetrates through the bottom of the shell side plate 102, and is connected to a cleaning liquid supply line 140. The cleaning liquid discharge pipe 146 communicates with the interior of the cleaning bath 30, and is connected to a cleaning liquid discharge line 144. The cleaning liquid is supplied through the cleaning liquid supply pipe 142 into the inner shell 100 in the second state. Further, by transforming the inner shell 100 from the second state to the first state, the cleaning liquid in the inner shell 100 is introduced to the bottom of the cleaning bath 30 through the gaps formed between the shell side plate 102 and the shell end plates 106, 108, and is discharged out of the cleaning bath 30 through the cleaning liquid discharge pipe 146.

A gap between the cleaning liquid supply pipe 142 and the cleaning bath 30 is sealed with an O-ring (not shown) so that the inner shell 100 can be attached and detached to and from the cleaning bath 30.

An exemplary cleaning process of cleaning a plated substrate W, together with the substrate holder 18, with use of the above-described cleaning bath 30 will now be described. A plating solution is likely to remain on the uneven surface of the substrate holder 18, especially on the contact portion $D_1$ (see FIG. 5) of the surface of the substrate W contacting the substrate-side sealing member 66. Therefore, it is necessary to remove the plating solution remaining on such stepped portion by the supply of the cleaning liquid.

First, when the inner shell 100 is in the first state in which the shell end plates 106, 108 are opened as shown in FIG. 6, the substrate holder 18 holding the substrate W is moved to a position just above the inner shell 100. The substrate holder 18 is then lowered to place the substrate W at a predetermined position in the inner shell 100. The substrate 18 being lowered does not make contact with the inner shell 100 in the first state. Thus, the inner shell 100 does not interfere with the movement (i.e., the downward movement) of the substrate holder 18.

Next, the opening and closing mechanism 124 transforms the inner shell 100 from the first state to the second state in which the shell end plates 106, 108 are closed, shown in FIG. 7. The inner surface of the inner shell 100 (inner surface of the shell end plate 106) in the second state has such a configuration that follows the uneven configuration of the front surfaces of the substrate holder 18 and the substrate W that are housed at the predetermined position in the inner shell 100. Thus, the inner shell 100 has such an interior configuration as to minimize the gap formed between the inner surface of the inner shell 100 and the substrate holder 18 holding the substrate W. The inner shell 100, in which the substrate holder 18 is housed, therefore has a fairly small interior volume. The portions of the inner shell 100 other than the top portion are liquid-tightly sealed with the sealing members 110. The interior volume of the inner shell 100 in which the substrate holder 18 is housed, i.e., the volume of the cleaning liquid to be stored in the inner shell 100, is e.g., about 1.0 L to 1.5 L in the case of a substrate W having a diameter of 450 mm.

Next, supply of the cleaning liquid, such as pure water, into the inner shell 100 in the second state is started. The cleaning liquid is gradually supplied into the interior space of the inner shell 100 and eventually comes to overflow the inner shell 100 through the overflow holes 106*a*, 108*a*. In this embodiment the cleaning liquid is discharged out of the cleaning bath 30 through the cleaning liquid discharge pipe 146 and the cleaning liquid discharge line 144. The cleaning liquid is supplied into the inner shell 100 at a high flow rate, so that the cleaning liquid that has overflown through the overflow holes 106*a*, 108*a* is temporarily collected on the bottom of the cleaning bath 30. The cleaning bath 30 is provided with a liquid level sensor (not shown). If the liquid level of the cleaning liquid that has accumulated on the bottom of the cleaning bath 30 reaches a level H1, it is determined that the interior space of the inner shell 100 is filled with the cleaning liquid. Then, the supply of the cleaning liquid is stopped. Because of the fairly small interior volume of the inner shell 100, the supply of the cleaning liquid can be completed in a short time, such as about 5 to 7 seconds. The cleaning liquid temporarily collected on the bottom of the cleaning bath 30 is spontaneously discharged through the cleaning liquid discharge pipe 146 with the elapse of time.

The cleaning bath 30 is configured to surround the inner shell 100 in order to prevent scattering of the cleaning liquid that has overflown the inner shell 100 or scattering of the cleaning liquid discharged from the inner shell 100. Thus, the cleaning liquid need not necessarily be collected on the bottom of the cleaning bath 30. The cleaning liquid overflowing through the overflow holes 106*a*, 108*a* may be directly detected, or the flow of the cleaning liquid in the cleaning liquid discharge pipe 146 may be detected, so long as it is possible to determine, by any other device, that the inner shell 100 is filled with the cleaning liquid. Alternatively, an integrated value of the flow rate of the cleaning liquid, which is measured by a flow meter (not shown) provided in the cleaning liquid supply line 140, may be calculated, and the supply of the cleaning liquid may be stopped if the integrated value reaches a predetermined value.

The inner shell 100 is kept filled with the cleaning liquid for a predetermined period of time. The plating solution, adhering to the substrate W and the substrate holder 18, is removed (cleaned off) from them basically by diffusion due to a difference in the concentration between the liquids.

After the predetermined time has elapsed, the opening and closing mechanism 124 transforms the inner shell 100 from the second state in which the shell end plates 106, 108 are closed, shown in FIG. 7, to the first state in which the shell end plates 106, 108 are opened, shown in FIG. 6. Because the shell end plates 106, 108 are separated from the scaling members 110 attached to the shell side plate 102 by this operation, the cleaning liquid stored in the inner shell 100 quickly (in one or two seconds) flows out through the gaps between the shell side plate 102 and the shell end plates 106, 108. The cleaning liquid that has flowed out of the inner shell 100 is temporarily collected on the bottom of the cleaning bath 30. As a result, the surface level of the cleaning liquid collected on the bottom of the cleaning bath 30 becomes higher than the above-described liquid level H1 set in the liquid level sensor. The cleaning liquid temporarily collected on the bottom of the cleaning bath 30 is spontaneously discharged through the cleaning liquid discharge pipe 146 with the elapse of time, whereby the first cleaning cycle of cleaning the substrate W and the substrate holder 18 with use of the cleaning liquid supplied into the inner shell 100 is terminated. If the surface level of the cleaning liquid collected on the bottom of the cleaning bath 30 does not become lower than the liquid level H1 after a predetermined time has elapsed from the opening of the shell end plates 106, 108, then it is determined that an abnormality has occurred in the discharge of the cleaning liquid from the cleaning bath 30, and an error signal is issued.

After the completion of discharge of the cleaning liquid from the inner shell 100 is detected, i.e., the completion of the first cleaning cycle is detected, the inner shell 100 is transformed from the first state to the second state, and a second cleaning cycle is started by supplying a cleaning liquid into the inner shell 100 in the second state. The cleaning liquid for use in the second cleaning cycle is not the one that has once been discharged in the first cleaning cycle, but a newly-supplied cleaning liquid.

The above-described cleaning cycle is repeated multiple times (e.g., three times), until the cleaning process of the substrate W and the substrate holder 18 with use of the cleaning liquid is completed. A point of time when all of the cleaning liquid existing in the cleaning liquid discharge line 144 is discharged is determined to be a point of time when the discharge of the cleaning liquid from the cleaning bath 30 is completed.

When the cleaning process is terminated, the inner shell 100 is in the first state in which the shell end plates 106, 108 are opened. In this state, the second transporter 44 raises the substrate holder 18, holding the substrate W, from the cleaning bath 30, and transports the substrate holder 18 to the next process.

The cleaning bath 30 receives the cleaning liquid that has overflowed the inner shell 100 or the cleaning liquid that has been discharged from the inner shell 100. It is therefore desirable to provide a dedicated nozzle for periodically cleaning the inner wall of the cleaning bath 30 in order to prevent contamination of the inner wall of the cleaning bath 30 due to accumulation of components of the plating solution. As an alternative, the cleaning bath 30 may be configured to be capable of being filled with pure water to perform cleaning of the inner wall. In that case, the cleaning liquid discharge line 144 may be provided with an on-off valve. Such cleaning of the interior of the cleaning bath 30 may be performed either periodically or every time the substrate W and the substrate holder 18 are cleaned in the inner shell 100. Alternatively, cleaning of the interior of the cleaning bath 30 may be performed independently.

Figure 10:
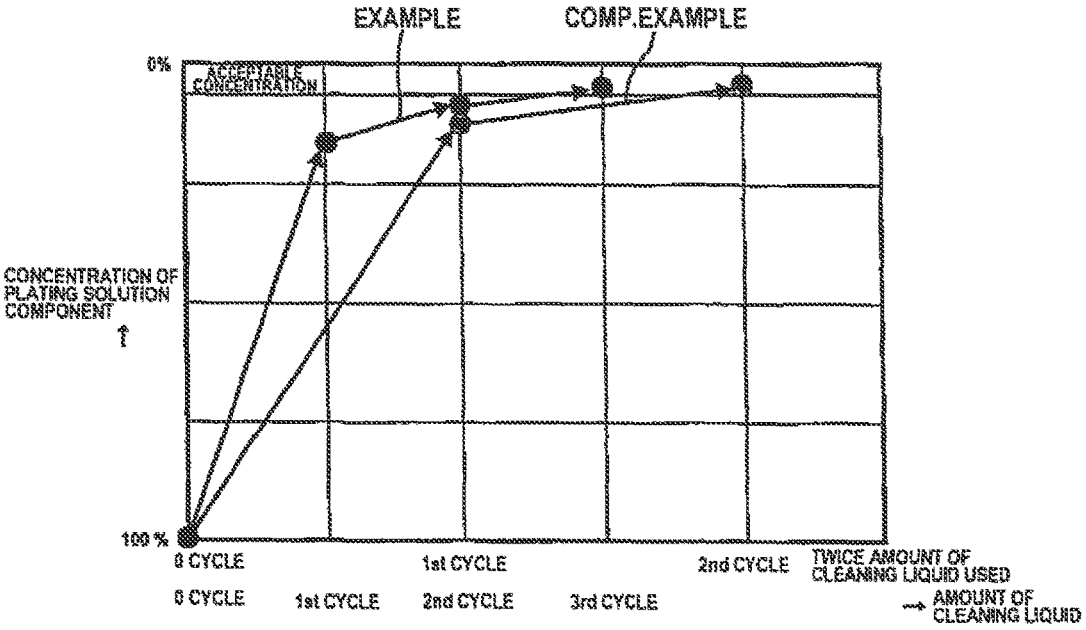
FIG. 10 is a graph showing experimental results of Example 1 which used the cleaning bath shown in FIGS. 6 to 9 and experimental results of Comparative Example 1 which used a conventional cleaning bath.

FIG. 10 is a graph showing experimental results of Example 1 which used the cleaning bath 30 and experimental results of Comparative Example 1 which used a conventional cleaning bath. In Example 1, cleaning of a substrate and a substrate holder was performed by supplying a predetermined amount of cleaning liquid into the inner shell 100 in the second state, followed by discharge of the cleaning liquid from the inner shell 100. This cleaning cycle was repeated three times. After each cleaning cycle, a concentration of a component of a plating solution adhering to the substrate and the substrate holder was measured. In FIG. 10, the concentration of the component of the plating solution before cleaning is defined as 100%. In Comparative Example 1, cleaning of a substrate and a substrate holder was performed using a conventional cleaning bath (i.e., a cleaning bath which is not provided with an inner shell and which simply stores a cleaning liquid therein). More specifically, cleaning was carried out by supplying the same cleaning liquid as used in Example 1, but in an amount that is twice the amount used in Example 1, into the cleaning bath in which the substrate holder, holding the substrate, was disposed, followed by discharge of the cleaning liquid from the cleaning bath. This cleaning cycle was repeated twice. After each cleaning cycle, the concentration of the same component of the plating solution adhering to the substrate and the substrate holder was measured. The results of the measurement are shown in FIG. 10 in terms of the relationship between the plating solution component concentration and an amount of the cleaning liquid used.

As can be seen in FIG. 10, the cleaning performance achieved by one cleaning cycle in Example 1 is low because the amount of the cleaning liquid supplied into the inner shell 100 is smaller than (one-half of) the amount of the cleaning liquid supplied into the cleaning bath in Comparative Example 1; however, the cleaning process of Example 1, which repeats the cleaning cycle three times, can achieve the same level of cleanliness as achieved by the cleaning process of Comparative Example 1 which repeats twice the cleaning cycle using the cleaning liquid in an amount which is twice that of Example 1. The total amount of the cleaning liquid used in Example 1 was ¾ of that of Comparative Example 1.

When the substrate holder 18 is lowered into the inner shell 100 in the first state in which the shell end plates 106, 108 are opened, a cleaning liquid may be supplied at a low flow rate from shower nozzles 149 shown in FIG. 6 in order to rinse a plating solution from the surfaces of the substrate W and the substrate holder 18. With this rinsing operation, the used cleaning liquid, containing the plating solution in a high concentration, can be discharged out of the inner shell 100 before it is transformed into the closed second state. This rinsing operation can therefore increase the cleaning efficiency while reducing the total amount of the cleaning liquid used.

According to this embodiment, the interior volume of the inner shell 100 can be made small. It therefore becomes possible to reduce the time required for supplying the cleaning liquid into the inner shell 100. Because of the small gaps G1, G2 between the substrate holder 18 (and the substrate W) and the shell end plates 106, 108, the cleaning liquid can flow along the substrate holder 18 and the substrate W at a high speed, thus increasing the cleaning effect of the substrate W and the substrate holder 18. In this embodiment, in order to prevent the cleaning liquid from overflowing from the top opening of the inner shell 100, labyrinth seals 120 are provided at the tops of the shell end plates 106, 108 to narrow the top opening. In addition, the supply of the cleaning liquid is stopped as soon as the inner shell 100 is filled with the cleaning liquid.

In order to prevent the cleaning liquid from overflowing from the top opening of the inner shell 100 when supplying the cleaning liquid, the supply of the cleaning liquid may be reduced when the surface level of the cleaning liquid in the inner shell 100 reaches a predetermined high level. By stopping the supply of the cleaning liquid as soon as the inner shell 100 has become filled with the cleaning liquid, the amount of the cleaning liquid used in one cleaning cycle can be minimized. Further, by repeating such a cleaning cycle multiple times, the total amount of the cleaning liquid used can be reduced.

Similarly, the use of the inner shell 100 having a small interior volume can reduce the time required for discharging the cleaning liquid from the inner shell 100. In particular, when the shell end plates 106, 108 are opened, the cleaning liquid is discharged from the inner shell 100 through the gaps formed between the shell side plate 102 and the shell end plates 106, 108. Since the cleaning liquid spills into the interior of the cleaning bath 30 in a moment, the discharge time of the cleaning liquid can be further reduced.

According to this embodiment, the cleaning liquid supply time and the cleaning liquid discharge time in one cleaning cycle can be reduced with the small interior volume of the inner shell 100. It therefore becomes possible to increase the number of cleaning cycles without a decrease in the throughput.

A sequence of plating process steps performed by the above-described plating apparatus will now be described. First, one substrate is taken by the substrate transport device 22 out of the cassette 10 mounted on the cassette table 12, and the substrate is placed on the aligner 14, which aligns an orientation flat or a notch of the substrate in a predetermined direction. After the alignment operation, the substrate is transported to the substrate loading device 20 by the substrate transport device 22.

Two substrate holders 18, housed in the stocker 24, are simultaneously gripped by the first transporter 42, and transported to the substrate loading device 20. The substrate holders 18 are lowered in a horizontal position simultaneously until the two substrate holders 18 are placed on the stage plate 52 of the substrate loading device 20, and then two pneumatic cylinders are actuated to open the second holding members 58 of the two substrate holders 18.

The substrate which has been transported by the substrate transport device 22 is inserted into the substrate holder 18 positioned on the center side, and the pneumatic cylinder is reversely actuated to close the second holding member 58. The second holding member 58 is then locked by means of a locking/unlocking mechanism (not shown). After the substrate holder 18 is loaded with the substrate, the stage plate 52 is slid laterally, and the other substrate holder 18 is loaded with a substrate in the same manner. Thereafter, the stage plate 52 is returned to its original position.

The substrate is mounted to the substrate holder 18 with its front surface (to-be-plated surface) exposed in the opening of the substrate holder 18. To prevent intrusion of the plating solution into the internal space of the substrate holder 18, the gap between the peripheral portion of the substrate and the second holding member 58 is sealed with the substrate-side sealing member 66, and the gap between the first holding member 54 and the second holding member 58 is sealed with the holder-side sealing member 68. The substrate W, at a sealed portion not in contact with the plating solution, electrically connects with the electrical contacts 88. Electric wires extending from the electrical contacts 88 are connected to the connecting terminal 91 of the substrate holder 18. Therefore, an electric current can be supplied to e.g., a seed layer of the substrate by connecting a power source to the connecting terminal 91. The substrate loading device 20 has a sensor for sensing a contact between the substrate W, held by the substrate holder 18, and the electrical contacts 88. The sensor, when it detects poor contact between the substrate W and the electrical contacts 88, outputs a signal to a controller (not shown).

The two substrate holders 18, each holding the substrate, are transported from the substrate loading device 20 to the pre-wetting bath 26 by the first transporter 42 of the substrate holder transport device 40. The first transporter 42 lowers the substrate holders 18 to immerse the substrates, together with the substrate holders 18, in a pre-wetting liquid (e.g., pure water) in the pre-wetting bath 26.

Next, the two substrate holders 18 holding the substrates are transported from the pre-wetting bath 26 to the pre-soaking bath 28 by the first transporter 42. In the pre-soaking bath 28, a surface oxide film of each substrate is etched away, thereby exposing a clean metal surface. Thereafter, the substrate holders 18 holding the substrates are transported to the first cleaning bath 30*a* by the first transporter 42. In the first cleaning bath 30*a*, the substrates and the substrate holders 18 are cleaned with a cleaning liquid supplied into the first cleaning bath 30*a*. Pure water or a chemical liquid can be used as the cleaning liquid.

The substrate holders 18, holding the cleaned substrates, are transported from the first cleaning bath 30*a* to the plating bath 34 by the second transporter 44 of the substrate holder transport device 40. The substrate holders 18 are lowered by the second transporter 44 into the plating cells 38, and are suspended from the tops of the plating cells 38. The second transporter 44 of the substrate holder transport device 40 sequentially repeats the above operation to sequentially transport substrate holders 18, each holding a substrate, to the plating cells 38 of the plating bath 34.

After setting substrates in all the plating cells 38, plating of the surface of each substrate is carried out by applying a plating voltage between each substrate and an anode (not shown) in each plating cell 38 while reciprocating the paddle parallel to the surface of the substrate by means of the paddle drive device 46. Each substrate holder 18 is suspended and fixed with the holder hangers 90 supported on the top of each plating cell 38. During plating, an electric current is supplied from the plating power source to the seed layer of the substrate through the electrical conductors 86 and the electrical contacts 88. During the plating, the plating solution overflows the plating cells 38 into the overflow bath 36, and is returned from the overflow bath 36 to the plating cells 38 through a circulation line (not shown). The plating solution circulates at all times basically during the operation of the apparatus. The plating solution is kept at a constant temperature by means of a not-shown constant-temperature unit provided in the circulation line.

After the plating operation is terminated, the application of the plating voltage and the reciprocation of the paddles are stopped. The two substrate holders 18, each loaded with the plated substrate, are transported from the plating bath 34 to the second cleaning bath 30 by the second transporter 44 of the substrate holder transport device 40. In the second cleaning bath 30, the substrates and the substrate holders 18 are cleaned with the cleaning liquid supplied into the inner shell 100, as described above. The cleaning in the second cleaning bath 30 may preferably be repeated multiple times.

The substrate holders 18, holding the cleaned substrates, are transported from the second cleaning bath 30 to the blow bath 32 by the second transporter 44. In the blow bath 32, air or nitrogen gas is ejected onto the surfaces of the substrates, held by the substrate holders 18, to remove liquid droplets from the substrate surfaces, thereby drying the substrates.

The two substrate holders 18 after drying in the blow bath 32 are transported to the substrate loading device 20 by the first transporter 42, and are placed on the stage plate 52 of the substrate loading device 20. A substrate holder 18, in which is housed a substrate whose contact with the electrical contacts 88 has been determined to be poor by the sensor provided in the substrate loading device 20 and which has been stored in the stocker 24, is also transported to the substrate loading device 20 and placed on the stage plate 52.

The second holding member 58 of the substrate holder 18 positioned on the center side is unlocked by means of the locking/unlocking mechanism, and the pneumatic cylinder is actuated to open the second holding member 58. The substrate transport device 22 removes the substrate from the substrate holder 18, and transports the substrate to the spin rinse drier 16, where the substrate is spin-dried (drained) by high-speed rotation of the spin rinse drier 16. The dried substrate is returned by the substrate transport device 22 to the cassette 10.

After or in parallel with returning the substrate, which has been removed from the one substrate holder 18, to the cassette 10, the stage plate 52 is slid laterally and the other substrate is removed from the other substrate holder 18. The substrate is then spin-dried by the spin rinse drier 16, and the dried substrate is returned to the cassette 10 by the substrate transport device 22.

FIG. 11 is a schematic view of a cleaning bath 30 according to another embodiment. The cleaning bath 30 of this embodiment differs from the embodiment shown in FIGS. 6 through 9 in that a gas feed line 150 is coupled to the cleaning liquid supply line 140 so as to feed a gas, such as air or $N_2$ gas, into a cleaning liquid, such as pure water, to be supplied into the inner shell 100 in the second state. A very small amount of the gas is fed into the cleaning liquid. It is verified from experiment that the cleaning power of the cleaning liquid, to be used in the cleaning shell 100, can be enhanced by a gas, such as air or $N_2$ gas, that has been fed into the cleaning liquid before it is supplied into the inner shell 100.

FIG. 12 is a schematic view of a cleaning bath 30 according to yet another embodiment. The cleaning bath 30 of this embodiment differs from the embodiment shown in FIGS. 6 through 9 in that instead of the opening and closing mechanism 124, the cleaning bath 30 is provided with an oscillation mechanism 158 which functions also as an opening and closing mechanism for opening and closing the shell end plates 106, 108. The oscillation mechanism 158 includes a pair of open-close rods 152, and a pair of servo motors 154 which can control the positions of the open-close rods 152. A distal end of each open-close rod 152 is rotatably coupled to the upper end of each of operation rods 156 which are secured to the upper ends of the shell end plates 106, 108, respectively.

In this embodiment, the oscillation mechanism 158 not only opens and closes the shell end plates 106, 108, but can also force the shell end plates 106, 108 to oscillate while they are in the closed state. By causing the shell end plates 106, 108 to oscillate on the order of, e.g., 0.1 mm in this manner, the interior volume of the inner shell 100 in the second state is changed and the surface level of the cleaning liquid in the inner shell 100 is moved vertically e.g., on the order of 5 mm. This oscillating operation can enhance the cleaning power of the cleaning liquid.

FIG. 13 is a diagram illustrating varying positions of the shell end plate 106 when it is opened, closed, and oscillating. Although not illustrated, the position of the other shell end plate 108 varies in the same way as shown in FIG. 13. A symbol A in FIG. 13 shows a position of the shell end plate 106 when it is in the opened state, a symbol B shows a position of the shell end plate 106 when it is in the closed state, and a symbol C shows a position of the shell end plate 106 when it is oscillating in the closed state. A symbol V represents an amplitude of the shell end plate 106 when it is oscillating. The amplitude V is on the order of 0.1 mm, e.g., in a range of 0.1 mm to 0.2 mm. When the shell end plates 106, 108 are oscillating, the surface level of the cleaning liquid in the inner shell 100 fluctuates vertically within the range of about 1 mm to 5 mm, for example.

FIG. 14 is a graph showing a relationship between the position of the shell end plate 106 and time when the shell end plate 106 is opened, closed, and oscillating. First, the shell end plate 106 in the opened position indicated by the symbol A shown in FIG. 13 is moved to the closed position indicated by the symbol B shown in FIG. 13 (time t1). The inner shell 100 is filled with the cleaning liquid in the above-described manner while the shell end plate 106 (and the shell end plate 108) is kept in the closed state (time t1-t2). Next, the shell and plate 106 in the closed position indicated by the symbol B is moved to the position indicated by the symbol C shown in FIG. 13 (time t2). Thereafter, the shell end plate 106 is returned to the position indicated by the symbol B (time t3). The time interval between t2 and t3 is, for example, 0.5 seconds. Next, the shell end plate 106 in the position indicated by the symbol B is again moved to the position indicated by the symbol C (time t4). The time interval between t3 and t4 is, for example, 0.5 seconds. The movement (i.e., the oscillation) of the shell end plate 106 is repeated n times, and then the shell end plate 106 in the closed position is moved to the opened position indicated by the symbol A shown in FIG. 13 (time tn).

FIG. 15 is a schematic view of a cleaning bath 30 according to yet another embodiment. The cleaning bath 30 of this embodiment differs from the embodiment shown in FIGS. 6 through 9 in that a diaphragm drive mechanism 162 is incorporated in the shell end plate 106 which is disposed on the front surface side of the substrate holder 18. The diaphragm drive mechanism 162 includes a diaphragm 160 disposed so as to contact the cleaning liquid supplied into the inner shell 100. Air is supplied into and discharged from a space formed inside the diaphragm 160 to thereby vibrate the diaphragm 160.

In this embodiment, the cleaning liquid is supplied into the inner shell 100, and then the diaphragm 160 is vibrated by the diaphragm drive mechanism 162, thereby causing the surface level of the cleaning liquid to fluctuate vertically in the inner shell 100 in the range of 1 mm to 2 mm, for example. This operation can enhance the cleaning power of the cleaning liquid.

Instead of the diaphragm drive mechanism 162, an ultrasonic oscillator may be used to cause the surface level of the cleaning liquid to fluctuate vertically in the inner shell 100.

FIG. 16 is a schematic view of a cleaning bath 30 according to yet another embodiment. The cleaning bath 30 of this embodiment differs from the embodiment shown in FIGS. 6 through 9 in that a syringe mechanism 164 is coupled to the cleaning liquid supply line 140. In this embodiment, after filling the inner shell 100 with the cleaning liquid, the syringe mechanism 164 causes the surface level of the cleaning liquid to fluctuate vertically in the inner shell 100 on the order of 5 mm, for example. A pump device may be used instead of the syringe mechanism 164.

FIG. 17 is a schematic view of a cleaning bath 30 according to yet another embodiment. The cleaning bath 30 of this embodiment differs from the embodiment shown in FIGS. 6 through 9 in that the shell end plate 106 disposed at the front surface side of the substrate holder 18 has, in its interior, a cleaning liquid storing chamber 166, and that the cleaning liquid supply pipe 142 communicates with the cleaning liquid storing chamber 166. The shell end plate 106 has a number of through-holes 168 which are arranged so as to face the entire surface of the substrate W and which communicate with the cleaning liquid storing chamber 166.

According to this embodiment, the cleaning liquid can be supplied into the inner shell 100 in the second state through the through-holes 168 provided in the shell end plate 106, thereby selectively cleaning the surface of the substrate W in its entirety.

In this embodiment the cleaning liquid supply pipe 142 is coupled to the shell end plate 106 which is configured to open and close. It is therefore preferred to use a flexible tube, such as a PFA tube, as the cleaning liquid supply pipe 142. The cleaning bath 30 of this embodiment may also be provided with a blow line that branches off from the cleaning liquid supply pipe 142. After the cleaning liquid is discharged from the inner shell 100, a gas (air or $N_2$ gas) is ejected toward the substrate W from the through-holes 168 to remove liquid droplets from the substrate holder 18 and the substrate W. In this embodiment, the cleaning bath 30 may preferably be provided with an exhaust duct for recovering the gas.

FIG. 18 is a schematic view of a cleaning bath 30 according to yet another embodiment. The cleaning bath 30 of this embodiment differs from the embodiment shown in FIGS. 6 through 9 in that the shell end plate 106 disposed on the side of the front surface of the substrate holder 18 has, in its interior, a cleaning liquid storing chamber 166, and that the cleaning liquid supply pipe 142 communicates with the cleaning liquid storing chamber 166. The shell end plate 106 has a plurality of peripheral holes 170 at positions facing a peripheral portion of the substrate W, and further has a central hole 172 at a position facing a central portion of the substrate W. The peripheral holes 170 and the central hole 172 communicate with the cleaning liquid storing chamber 166.

In this embodiment, when the cleaning liquid is supplied into the inner shell 100 in the second state, the cleaning liquid can be supplied intensively to the peripheral portion of the substrate W through the peripheral holes 170, thereby efficiently cleaning an area along the contact portion $D_1$ (see FIG. 5) in the peripheral area of the surface of the substrate W that contacts the substrate-side sealing member 66. Furthermore, the cleaning liquid is supplied intensively to the central area of the substrate W through the central hole 172, thus forming flow of the cleaning liquid in the radial direction of the substrate W on the substrate surface. Such radial flow of the cleaning liquid can clean the area along the substrate-side sealing member 66. In the embodiment shown in FIG. 18, the central hole 172 may be omitted, i.e., only the peripheral holes 170 may be provided in the shell end plate 106.

FIG. 19 is a schematic view of a cleaning bath 30 according to yet another embodiment. The cleaning bath 30 of this embodiment differs from the embodiment shown in FIGS. 6 through 9 in that the cleaning bath 30 is further provided with a substrate holder moving mechanism 174 for horizontally moving the substrate holder 18. The substrate holder moving mechanism 174 is configured to move the substrate holder 18 back and forth and/or from side to side, i.e., to cause the substrate holder 18 to oscillate horizontally.

According to this embodiment, after the cleaning liquid is supplied into the inner shell 100, the substrate holder 18 is slightly moved back and forth and/or from side to side by the substrate holder moving mechanism 174, thereby agitating the cleaning liquid in the inner shell 100. This operation can enhance the cleaning power of the cleaning liquid.

FIGS. 20 through 23 shows cleaning baths 30 according to other embodiments as viewed from above. The cleaning bath 30 shown in FIG. 20 differs from the embodiment shown in FIGS. 6 through 9 in that the opening and closing mechanism 124 for opening and closing the shell end plates 106, 108 includes a pair of connection rods 174 which are movable in synchronization in directions closer to and away from each other and which are kept parallel to each other during the movement. Beside the cleaning bath 30 is disposed an opening and closing chuck 176 which is configured to move the pair of connection rods 174 in directions closer to and away from each other while keeping them parallel to each other. The shell end plates 106, 108 are secured to the connection rods 174, respectively.

In this embodiment the shell end plates 106, 108 are moved parallel to each other to be opened and closed. A pair of guides 178, extending horizontally in a direction perpendicular to the connection rods 174, is provided in the cleaning bath 30 so that the shell end plates 106, 108 can move while keeping parallel to each other.

FIG. 21 is a schematic view of a cleaning bath 30 according to yet another embodiment. The cleaning bath 30 of this embodiment differs from the embodiment shown in FIGS. 6 through 9 in that the opening and closing mechanism 124 for opening and closing the shell end plates 106, 108 includes a pair of opening and closing chucks 180 disposed at both sides of the cleaning bath 30, and a pair of connection rods 182 extending between the opening and closing chucks 180. The connection rods 182 are movable in synchronization in directions closer to and away from each other while they are kept parallel to each other. The shell end plates 106, 108 are secured to the connection rods 182.

Also in this embodiment, the pair of guides 178 is provided at a predetermined position in the cleaning bath 30 so that the shell end plates 106, 108 can move while keeping parallel to each other.

FIG. 22 is a schematic view of a cleaning bath 30 according to yet another embodiment. The cleaning bath 30 of this embodiment differs from the embodiment shown in FIGS. 6 through 9 in that the opening and closing mechanism 124 for opening and closing the shell end plates 106, 108 includes a pair of pneumatic cylinders 184 disposed beside the cleaning bath 30. Piston rods 186 of the pneumatic cylinders 184 are coupled to the shell end plates 106, 108, respectively. Also in this embodiment, the pair of guides 178 is provided at a predetermined position in the cleaning bath 30.

FIG. 23 is a schematic view of a cleaning bath 30 according to yet another embodiment. The cleaning bath 30 of this embodiment differs from the embodiment shown in FIGS. 6 through 9 in that the opening and closing mechanism 124 for opening and closing the shell end plates 106, 108 includes an opening and closing chuck 190 disposed beside the cleaning bath 30, and a pair of connection rods 194 which, by the actuation of the opening and closing chuck 190, pivot on an axis 192 in synchronization with each other in opposite directions. The shell end plates 106, 108 are secured to the pair of connection rods 194, respectively.

FIGS. 24 and 25 show a cleaning bath 30 according to yet another embodiment. The inner shell 100 of this embodiment includes an open-top elastic bladder 200 (e.g., made of Viton), a pair of airbags 202 interposed between the bladder 200 and the inner surface of the cleaning bath 30, and a projection 204 provided at a predetermined position on an inner surface of the bladder 200. When the airbags 202 are shrunk, the inner shell 100 becomes in the first state in which the substrate holder 18, holding the substrate W, is placed at a predetermined position in the bladder 200, as shown in FIG. 24. When the airbags 202 are inflated, the inner shell 100 becomes in the second state in which the inner surface of the inner shell 100 has a configuration that follows the exterior configuration of the substrate holder 18 holding the substrate W, as shown in FIG. 25. When the inner shell 100 is in the second state, the projection 204 lies close to the substrate W held by the substrate holder 18.

A cleaning liquid delivery pipe (or a cleaning liquid supply conduit) 206, connected to a cleaning liquid supply line and a cleaning liquid discharge line, is provided at the bottom of the cleaning bath 30. The cleaning liquid delivery pipe 206 communicates with the interior of the bladder 200.

In operation, as shown in FIG. 24, when the inner shell 100 is in the first state in which the airbags 202 are shrunk, the substrate holder 18, holding the substrate W, is lowered, without interference with the inner shell 100, to place the substrate W at a predetermined position in the inner shell 100. The airbags 202 are then inflated to transform the inner shell 100 into the second state in which the inner surface of the inner shell 100 has a configuration that follows the uneven exterior configuration of the substrate holder 18 holding the substrate W, as shown in FIG. 25. Thereafter, the cleaning liquid is supplied through the cleaning liquid delivery pipe 206 into the inner shell 100 (i.e., into the bladder 200) to clean the substrate W together with the substrate holder 18. After the completion of the cleaning, the cleaning liquid is discharged out of the inner shell 100 (i.e., out of the bladder 200) through the cleaning liquid delivery pipe 206. The cleaning bath 30 of this embodiment can thus reduce the amount of the cleaning liquid used in one cleaning cycle for cleaning of the substrate W and the substrate holder 18.

The airbags 202 are preferably made of a corrosion-resistant material. Other types of actuators, such as pneumatic cylinders, may be used instead of the airbags 202.

FIG. 26 is a schematic view of a cleaning bath 30 according to yet another embodiment. In this embodiment a substrate W is cleaned together with a substrate holder 210, with both a first surface (a front surface) and a second surface (a back surface) of the substrate W exposed. FIG. 27 is an enlarged view of a portion of the substrate holder 210 which is cleaned in the cleaning bath 30.

As shown in FIG. 27, the substrate holder 210 includes a plate-like first holding member 212 and a plate-like second holding member 214, which are made of a resin material (e.g., HTPVC) and are openable and closable relative to each other through a hinge (not shown). The first holding member 212 has an open hole 212*a*, and the second holding member 214 has an open hole 214*a*. The first holding member 212 and the second holding member 214, when they are in the closed state (overlapped state), are held by a pair of openable and closable clamps 216 made of a resin material (e.g., HTPVC).

A seal ring 218, extending around the open hole 212*a*, is mounted to the first holding member 212 at a position facing the second holding member 214. A seal ring 220, extending around the open hole 214*a*, is mounted to the second holding member 214 at a position facing the first holding member 212. The seal rings 218, 220 are made of a rubber material (e.g., silicone rubber). An O-ring 222 is mounted on a surface, which faces the first holding member 212, of the second holding member 214. The O-ring 222 is arranged at the outer side of the seal ring 220.

The seal rings 218, 220 each have a rectangular cross-section and have sealing portions 218*a*, 220*a*, respectively, in their inner peripheral ends. When the first holding member 212 and the second holding member 214 are in the overlapped state with the substrate W interposed therebetween, the sealing portions 218*a*, 220*a* press on both surfaces of the substrate W, thus forming a hermetically enclosed space surrounded by the sealing portions 218*a*, 220*a* and the O-ring 222. This hermetically enclosed space is a sealed space which does not permit intrusion of a plating solution thereinto.

A plurality of conductive plates 224 are provided around the open hole 212*a* of the first holding member 212. Half of these conductive plates 224 are electrically connected via conductive pins 226 to one surface (e.g., the front surface) of the substrate W, while the other half of the conductive plates 224 are electrically connected via conductive pins 226 to the other surface (e.g., the back surface) of the substrate W. The conductive plates 224 are electrically connected to an external terminal provided in a holder hanger (not shown) of the substrate holder 210.

In the substrate holder 210, the substrate W is placed in a predetermined position on the first holding member 212 when the first holding member 212 and the second holding member 214 are in the opened state. Thereafter, the first holding member 212 and the second holding member 214 are closed through the hinge, and the pair of clamps 216 is rotated until peripheral portions of both the first holding member 212 and the second holding member 214 are inserted into a groove 216*a* of the clamps 216. The substrate W is thus held by the first holding member 212 and the second holding member 214.

When the substrate W is held by the first holding member 212 and the second holding member 214, the space surrounded by the sealing portions 218*a*, 220*a* of the seal rings 218, 220 and the O-ring 222 is sealed hermetically to be in a liquid-tight state which does not permit intrusion of a plating solution thereinto. The portion of the substrate W, lying on the outer side of the sealing portions 218*a*, 220*a*, lies in this sealed space, while the other portion of the substrate W, including the majority of the both surfaces, is exposed in the open holes 212*a*, 214*a*.

Recesses with fairly large volume are formed on both the front surface side and the back surface side of the substrate holder 210 when holding the substrate W. In view of this, as shown in FIG. 26, the shell end plate 106, located at the side of the front surface of the substrate holder 210, has on its inner surface an uneven portion 106*b* that follows the uneven external configuration of the front surface of the substrate holder 210. Further, the shell end plate 108, located at the side of the back surface of the substrate holder 210, has on its inner surface an uneven portion 108*b* that follows the uneven external configuration of the back surface of the substrate holder 210.

FIG. 28 shows a diagram illustrating an exemplary process of cleaning the interior of the cleaning bath 30 by storing a cleaning liquid in the cleaning bath 30. A valve 229 is provided in the cleaning liquid discharge line 144. With the valve 229 closed, the cleaning liquid is supplied from the cleaning liquid supply line 140 into the inner shell 100, and the cleaning liquid is further supplied through the overflow holes 106*a*, 108*a* into the cleaning bath 30. The supply of the cleaning liquid is continued until the liquid level in the cleaning bath 30 reaches a predetermined value H2. The inner shell 100 is preferably kept in the closed state (in the first state) during the cleaning of the cleaning bath 30 so that dirt, dispersed from the inner surface of the cleaning bath 30, will not enter the inner shell 100.

The cleaning liquid can be quickly discharged from the inner shell 100 by transforming the shell end plates 106, 108 from the second state (the closed state) to the first state (the opened state). This is desirable in the light of reduced processing time. However, because of the quick discharge of the cleaning liquid, the cleaning liquid may remain as droplets on the substrate W or the substrate holder 18 and may dilute a processing liquid in the next processing step. Thus, when raising the substrate holder 18 from the inner shell 100 after the completion of cleaning, it is desirable to eject air or $N_2$ gas from blow nozzles 230 onto the substrate holder 18 so as to force liquid droplets out of the substrate W and the substrate holder 18, as shown in FIG. 29. The supply of air or $N_2$ gas from the blow nozzles 230 is not to dry the substrate W and the substrate holder 18, but to reduce the amount of liquid droplets adhering to them. Therefore, the jet of air or $N_2$ gas is preferably at a low flow rate so that the gas does not scatter around.

FIG. 30 shows a process sequence of a cleaning process according to another embodiment, which is intended to address the problem of an increased amount of cleaning liquid droplets adhering to the substrate W or the substrate holder 18 after cleaning. In this cleaning process shown in FIG. 30, a cleaning cycle, involving supply and discharge of a cleaning liquid into and from the inner shell 100, is repeated several times. The cleaning liquid is slowly discharged from the inner shell 100 only in the last cleaning cycle so that the surface level of the cleaning liquid in the inner shell 100 is lowered gradually. This operation can prevent the cleaning liquid from remaining as droplets on the substrate W or the substrate holder 18. In particular, the shell end plates 106, 108 are opened not quickly but slowly so that the sealing members 110 on the shell side plate 102 are separated gradually from the upper portion of the shell end plate 106 or the shell end plate 108. For this purpose, it may be necessary to use, as an opening and closing mechanism for the shell end plates 106, 108, not an actuator using an pneumatic cylinder but an opening and closing mechanism having a speed control function, e.g., using a servo motor as shown in FIG. 12.

Although the embodiments have been described above, it should be understood that the present invention is not limited to the above embodiments, but various changes and modifications may be made to the embodiments without departing from the scope of the appended claims.

What is claimed is:

1. A substrate plating apparatus comprising:

a substrate holder configured to hold a substrate with a sealing member pressing on a peripheral portion of the substrate;

a plating bath configured to plate a surface of the substrate when the substrate, held by the substrate holder, is immersed in a plating solution;

a cleaning bath configured to clean the substrate holder and the substrate with a cleaning liquid;

an inner shell disposed in the cleaning bath and configured to house therein the substrate holder holding the substrate, the inner shell including a shell side plate and shell end plates disposed at both sides of the shell side plate, both of the shell end plates being configured to open and to close and having an inner surface which has an uneven configuration that follows an uneven exterior configuration of the substrate holder holding the substrate, one of the shell end plates having a plurality of through-holes facing a front side of the substrate holder; and a cleaning liquid supply conduit configured to be in communication with the plurality of through-holes and to supply a cleaning liquid through the plurality of through-holes into the inner shell when the inner shell is in a closed state to clean the substrate, together with the substrate holder, with the cleaning liquid.

2. The substrate plating apparatus according to claim 1, wherein a gap of 1 mm to 5 mm is formed between the inner surface of the inner shell in the closed state and the substrate holder.

3. The substrate plating apparatus according to claim 1, further comprising a gas feed line configured to feed a gas into the cleaning liquid to be supplied into the inner shell in the closed state.

4. The substrate plating apparatus according to claim 1, further comprising:

a mechanism configured to cause a surface level of the cleaning liquid in the inner shell to fluctuate vertically when the inner shell is in the closed state.

5. The substrate plating apparatus according to claim 4, wherein the mechanism is one of an oscillation mechanism configured to cause walls of the inner shell to oscillate, a diaphragm drive mechanism configured to vibrate a diaphragm in contact with the cleaning liquid in the inner shell, and a syringe mechanism or pump device configured to repeatedly supply and discharge the cleaning liquid into and from the inner shell.

6. The substrate plating apparatus according to claim 1, further comprising:

a substrate holder moving mechanism configured to cause the substrate holder to oscillate horizontally.

7. The substrate plating apparatus according to claim 1 further comprising a mechanism coupled to the inner shell, the mechanism configured to cause the shell end plates to move between being opened and being closed.

8. The substrate plating apparatus according to claim 7 wherein the mechanism configured to cause the shell end plates to move between being opened and being closed is configured to cause rotation of the shell end plates away from each other.

9. The substrate plating apparatus according to claim 7 wherein the mechanism configured to cause the shell end plates to move is coupled to a lid.

10. A substrate plating apparatus comprising:

a substrate holder configured to hold a substrate with a sealing member pressing on a peripheral portion of the substrate;

a plating bath configured to plate a surface of the substrate when the substrate, held by the substrate holder, is immersed in a plating solution;

a cleaning bath configured to clean the substrate holder and the substrate with a cleaning liquid;

an inner shell disposed in the cleaning bath and configured to house therein the substrate holder holding the substrate, the inner shell including a shell side plate and shell end plates disposed at both sides of the shell side plate, both of the shell end plates being configured to open and to close and having an inner surface which has an uneven configuration that follows an uneven exterior configuration of the substrate holder holding the substrate, one of the shell end plates having a plurality of peripheral holes and a central hole facing a front side of the substrate holder; and a cleaning liquid supply conduit configured to be in communication with the plurality of peripheral holes and the central hole and to supply a cleaning liquid through at least one of the plurality of peripheral holes and the central hole into the inner shell when the inner shell is in a closed state to clean the substrate, together with the substrate holder, with the cleaning liquid, the peripheral holes being arranged so as to face a peripheral portion of the substrate, the central hole being arranged so as to face a central portion of the substrate.

11. The substrate plating apparatus according to claim 10 further comprising a mechanism coupled to the inner shell, the mechanism configured to cause the shell end plates to move between being opened and being closed.

12. The substrate plating apparatus according to claim 11 wherein the mechanism configured to cause the shell end plates to move between being opened and being closed is further configured to cause rotation of the shell end plates.

13. The substrate plating apparatus according to claim 11 wherein the mechanism configured to cause the shell end plates to move is coupled to a lid.

* * * * *